US007603278B2

(12) United States Patent
Fukada et al.

(10) Patent No.: US 7,603,278 B2
(45) Date of Patent: Oct. 13, 2009

(54) SEGMENT SET CREATING METHOD AND APPARATUS

(75) Inventors: Toshiaki Fukada, Yokohama (JP); Masayuki Yamada, Kawasaki (JP); Yasuhiro Komori, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 520 days.

(21) Appl. No.: 11/225,178

(22) Filed: Sep. 14, 2005

(65) Prior Publication Data

US 2006/0069566 A1 Mar. 30, 2006

(30) Foreign Application Priority Data

Sep. 15, 2004 (JP) ..... 2004-268714

(51) Int. Cl.
*G10L 13/08* (2006.01)
*G10L 13/06* (2006.01)

(52) U.S. Cl. ..... 704/260; 704/267; 704/245; 704/200; 704/243; 704/254; 704/236; 704/258; 345/473; 434/156

(58) Field of Classification Search ..... 704/267, 704/245, 200, 243, 260, 236, 258, 254, 268; 345/473; 434/156
See application file for complete search history.

(56) References Cited

U.S. PATENT DOCUMENTS

| | | | | |
|---|---|---|---|---|
| 4,214,125 | A * | 7/1980 | Mozer et al. | 704/268 |
| 4,802,224 | A * | 1/1989 | Shiraki et al. | 704/245 |
| 5,278,942 | A * | 1/1994 | Bahl et al. | 704/200 |
| 5,613,056 | A * | 3/1997 | Gasper et al. | 345/473 |
| 5,740,320 | A * | 4/1998 | Itoh | 704/267 |
| 6,036,496 | A * | 3/2000 | Miller et al. | 434/156 |
| 6,411,932 | B1 * | 6/2002 | Molnar et al. | 704/260 |
| 6,912,499 | B1 * | 6/2005 | Sabourin et al. | 704/243 |
| 7,054,814 | B2 | 5/2006 | Okutani et al. | |
| 7,107,216 | B2 * | 9/2006 | Hain | 704/260 |
| 7,139,712 | B1 | 11/2006 | Yamada | |
| 2003/0050779 | A1 * | 3/2003 | Riis et al. | 704/236 |
| 2003/0088418 | A1 * | 5/2003 | Kagoshima et al. | 704/258 |
| 2003/0110035 | A1 * | 6/2003 | Thong et al. | 704/254 |
| 2004/0098248 | A1 | 5/2004 | Otani | 704/8 |

FOREIGN PATENT DOCUMENTS

| | | |
|---|---|---|
| JP | 08-263520 | 10/1996 |
| JP | 2583074 B | 11/1996 |

(Continued)

OTHER PUBLICATIONS

Nakajima, "English Speech Synthesis based on Multi-Level Context-Oriented-Clustering Method," IEICE, SP92-9, 1992, pp. 17-24 and English abstract thereof.

(Continued)

*Primary Examiner*—Vijay B Chawan
*Assistant Examiner*—Michael C Colucci
(74) *Attorney, Agent, or Firm*—Fitzpatrick, Cella, Harper & Scinto

(57) ABSTRACT

A segment set before updating is read, and clustering considering a phoneme environment is performed to it. For each cluster obtained by the clustering, a representative segment of a segment set belonging to the cluster is generated. For each cluster, a segment belonging to the cluster is replaced with the representative segment so as to update the segment set.

7 Claims, 27 Drawing Sheets

FOREIGN PATENT DOCUMENTS

| | | | |
|---|---|---|---|
| JP | 9-90972 | A | 4/1997 |
| JP | 9-281993 | | 10/1997 |
| JP | 2001-92481 | A | 4/2001 |
| JP | 2004-53978 | | 2/2004 |
| JP | 2004-252316 | | 9/2004 |

OTHER PUBLICATIONS

Hashimoto et al., "Speech Synthesis by a Syllable as a Unit of Synthesis Considering Environment Dependency—Generating Phoneme Clusters by Environment Dependent Clustering," Acoustical Society of Japan Lecture Article, Sep. 1995, pp. 245-246 and English translation thereof.

Kazuo Hakoda et al., NTT Human Interface Laboratories, "A Japanese Text-to-speech Synthesizer Based on COC Synthesis Method", vol. 90, No. 335, pp. 9-14 (1990), along with English-language abstract and English-language translation.

Official Action issued in Japanese Application No. 2004-268714.

* cited by examiner

601 c(0)
c(1)
c(2)
c(M)
⊿c(0)
⊿c(1)
⊿c(2)
⊿c(M)
601 c(0)
c(1)
c(2)
c(M)
601

111

| ID | PHONEME ENVIRONMENT | SEGMENT STORAGE ADDRESS |
|---|---|---|
| 1 | i−a+b | add11 |
| 2 | e−a+b | add12 |
| 3 | i−a+d | add13 |
| 4 | e−a+d | add14 |
| 5 | i−a+g | add15 |
| 6 | e−a+g | add16 |
| ... | ... | ... |

113

| ID | PHONEME ENVIRONMENT | SEGMENT STORAGE ADDRESS |
|---|---|---|
| 1 | i−a+b | add21 |
| 2 | e−a+b | add21 |
| 3 | i−a+d | add22 |
| 4 | e−a+d | add22 |
| 5 | i−a+g | add22 |
| 6 | e−a+g | add22 |
| ... | ... | ... |

FIG. 12B

| |
|---|
| c(0) |
| c(1) |
| c(2) |
| ⋮ |
| c(M) |
| F0 |
| power |
| duration |
| ⊿c(0) |
| ⊿c(1) |
| ⊿c(2) |
| ⋮ |
| ⊿c(M) |
| ⊿F0 |
| ⊿power |
| ⊿duration |

FIG. 12A

| |
|---|
| c(0) |
| c(1) |
| c(2) |
| ⋮ |
| c(M) |
| F0 |
| power |
| duration |

| ID | PHONEME ENVIRONMENT | SEGMENT STORAGE ADDRESS |
|---|---|---|
| 1 | e−a+b,Spkr1 | add31 |
| 2 | e−a+d,Spkr1 | add31 |
| 3 | e−a+g,Spkr1 | add31 |
| 4 | o−t+i,Spkr1 | add32 |
| 5 | o−t+e,Spkr1 | add32 |
| ... | ... | ... |
| 1001 | e−a+b,Spkr2 | add33 |
| 1002 | e−a+d,Spkr2 | add33 |
| 1003 | e−a+g,Spkr2 | add33 |
| 1004 | o−t+i,Spkr2 | add32 |
| 1005 | o−t+e,Spkr2 | add32 |
| ... | ... | ... |

FIG. 21

| PRE-CONVERSION PHONEME LABEL (LANGUAGE) | POST-CONVERSION PHONEME LABEL |
|---|---|
| a (JAPANESE) | A |
| i (JAPANESE) | I |
| k (JAPANESE) | K |
| p (JAPANESE) | P |
| t (JAPANESE) | T |
| ... | ... |
| ae (ENGLISH) | AE |
| ah (ENGLISH) | AH |
| ao (ENGLISH) | AO |
| k (ENGLISH) | K |
| p (ENGLISH) | P |
| t (ENGLISH) | T |
| ... | ... |
| a (CHINESE) | A |
| ai (CHINESE) | AI |
| an (CHINESE) | AN |
| ao (CHINESE) | CAO |
| t (CHINESE) | T |
| ... | ... |

FIG. 22

| PRE-CONVERSION PROSODY LABEL (LANGUAGE) | POST-CONVERSION PROSODY LABEL |
|---|---|
| ACCENT NUCLEUS (JAPANESE) | P |
| else (JAPANESE) | N |
| PRIMARY STRESS (ENGLISH) | P |
| SECONDARY STRESS (ENGLISH) | S |
| else (ENGLISH) | N |
| FIRST TONE (CHINESE) | N |
| SECOND TONE (CHINESE) | P |
| THIRD TONE (CHINESE) | S |
| FOURTH TONE (CHINESE) | P |
| else (CHINESE) | N |

SEGMENT SET CREATING METHOD AND APPARATUS

FIELD OF THE INVENTION

The present invention relates to a technique for creating a segment set which is a set of speech segments used for speech synthesis.

BACKGROUND OF THE INVENTION

In recent years, speech synthesis techniques are used for various apparatuses, such as a car navigation system. There are the following methods for synthesizing a speech waveform.

(1) Speech Synthesis Based on Source-Filter Models

Feature parameters of speech such as a formant and a cepstrum are used to configure a speech synthesis filter, where the speech synthesis filter is excited by an excitation signal acquired from fundamental frequency and voiced/unvoiced information so as to obtain a synthetic sound.

(2) Speech Synthesis Based on Waveform Processing

A speech waveform unit such as diphone or triphone is deformed to be a desired prosody (fundamental frequency, duration and power) and connected. The PSOLA (Pitch Synchronous Overlap and Add) method is representative.

(3) Speech Synthesis by Concatenation of Waveform

Speech waveform units such as syllables, words and phrases are connected.

In general, the (1) speech synthesis based on source-filter models and (2) speech synthesis based on waveform processing are suited to the apparatuses of which storage capacity is limited because these methods can render the storage capacity of a set of feature parameters of speech and a set of speech waveform units (segment set) smaller than the method of (3) speech synthesis by concatenation of waveform. As for the (3) speech synthesis by concatenation of waveform, it uses a longer speech waveform unit than the methods of (1) speech synthesis based on source-filter models and (2) speech synthesis based on waveform processing. Therefore, the method of (3) speech synthesis by concatenation of waveform requires the storage capacity of over ten MB to several hundred MB for the segment set per speaker, and so it is suited to the apparatuses of which storage capacity is abundant such as a general-purpose computer.

To generate a high-quality synthetic sound by the speech synthesis based on source-filter models or the speech synthesis based on waveform processing, it is necessary to create the segment set in consideration of differences in a phoneme environment. For instance, it is possible to generate a higher-quality synthetic sound by using a segment set (a triphone set) dependent on a phoneme context and having considered a surrounding phoneme environment rather than using a segment set (a monophone set) not dependent on the phoneme context and not having considered the surrounding phoneme environment. As for the number of segments of the segment set, there are several tens of kinds in the case of the monophone, several hundreds to a thousand and several hundreds of kinds in the case of the diphone, and several thousands to several tens of thousands in the case of the triphone although they may be different to a degree depending on a language and a definition of the monophone. Here, in the case of operating the speech synthesis on the apparatus of which resources are limited such as a cell-phone or a home electric appliance, there may be a need to reduce the number of segments due to a constraint on the storage capacity of an ROM and so on as to the segment set having considered the phoneme environment, such as the triphone or the diphone.

There are two approaches of reducing the number of segments of the segment set: a method of performing clustering to a set of voice units (entire speech database for training) for creating the segment set; and a method of applying the clustering to the segment set created by some method.

As for the former method, that is, the method of creating the segment set by performing the clustering to the entire speech database for training, the following methods are available: a method of performing data-driven clustering considering the phoneme environment to the entire speech database for training, acquiring a centroid pattern of each cluster and selecting it on synthesis to perform the speech synthesis (Japanese Patent No. 2583074 for instance); and a method of performing knowledge-based clustering considering the phoneme environment grouping identifiable phoneme sets (Japanese Patent Laid-Open 9-90972 specification, for instance).

As for the method of applying the clustering to the segment set created by some method, there is a method of reducing the number of segments by applying an HMnet to the segment set in units of CV or VC prepared in advance (Japanese Patent Laid-Open No. 2001-92481 for instance).

These conventional methods have the following problems.

First, according to the technique of Japanese Patent No. 2583074, the clustering is performed based only on a distance scale of a phoneme pattern (segment set) without using linguistic, phonological and phonetic specialized knowledge. Therefore, there are the cases where the centroid pattern is generated from phonologically dissimilar (unidentifiable) segment sets. If the synthetic sound is generated by using such a centroid pattern, there arise problems such as lack in intelligibility. To be more specific, it is necessary to perform the clustering by identifying phonologically similar triphones rather than simply clustering the phoneme environment such as the triphone.

Japanese Patent Laid-Open No. 9-90972 discloses a clustering technique considering the phoneme environment having grouped identifiable phoneme sets in order to deal with the problems of Japanese Patent No. 2583074. To be more precise, however, the technique used in Japanese Patent Laid-Open No. 9-90972 is a knowledge-based clustering technique, such as identifying a preceding phoneme of a long vowel with a preceding phoneme of a short vowel, identifying a succeeding phoneme of a long vowel with a succeeding phoneme of a short vowel, representing a preceding phoneme by one short vowel if the phoneme is an unvoiced stop, and representing a succeeding phoneme by one unvoiced stop if the succeeding phoneme is an unvoiced stop. The applied knowledge is also very simple, which is applicable only in the case where a unit of speech is the triphone. To be more specific, Japanese Patent Laid-Open No. 9-90972 has the problem that it is not possible to apply it to the segment set other than the triphone such as the diphone, deal with any other language than Japanese and have a desired number of segment sets (create scalable segment sets).

"English Speech Synthesis based on Multi-level context Oriented Clustering Method" by Nakajima (IEICE, SP92-9, 1992) (hereafter, "Non-Patent Document 1") and "Speech Synthesis by a Syllable as a Unit of Synthesis Considering Environment Dependency—Generating Phoneme Clusters by Environment Dependent Clustering" by Hashimoto and Saito (Acoustical Society of Japan Lecture Articles, p. 245-246, September 1995) (hereafter, "Non-Patent Document 2") disclose the method of using the clustering based on a phonological environment and the clustering based on the phoneme environment together in order to deal with the problems in Japanese Patent No. 2583074 and Japanese Patent Laid-Open No. 9-90972. According to Non-Patent Document 1 and Non-Patent Document 2, these inventions allow the clustering for identifying phonologically similar triphones, application to the segment set other than the triphone, handling of a language other than Japanese and creation of scalable segment sets. To obtain the segment set, however, the segment set is decided by performing the clustering to the entire speech segments for training in Non-Patent Document 1 and Non-Patent Document 2. Therefore, there is a problem that a spectral distortion in a cluster is considered but a spectral distortion at a connection point between the segments (concatenation distortion) is not considered. As it is described in Non-Patent Document 2 that a selection was made with an emphasis on consonants rather than vowels resulting in lower sound quality of the vowels, there is a problem that a selection result may not be appropriately obtained. To be more specific, on creating the segment set, it is not necessarily assured that the segment set selected by an automatic technique is optimal, but the sound quality can often be improved by manually replacing some segments thereof with other segments. For this reason, a required method is the method of performing the clustering to the segment set rather than performing the clustering to the entire speech segments for training.

Japanese Patent Laid-Open No. 2001-92481 discloses the method of reducing the number of segments by applying the HMnet to the selected segment set in units of CV or VC. However, the HMnet used by this method is context clustering by a maximum likelihood rule called a sequential state division method. To be more specific, the obtained HMnet may consequently have a number of phoneme sets shared in one state. However, how the phoneme sets are shared is completely data-dependent. Unlike Japanese Patent Laid-Open No. 9-90972 or Non-Patent Document 1 and Non-Patent Document 2, the identifiable phoneme sets are not grouped and the clustering is not performed with this group as a constraint. To be more specific, unidentifiable phoneme sets are shared as the same state, and so the same problem as in Japanese Patent No. 2583074 occurs.

In addition, there is the following problem relating to creation of the segment set of multiple speakers. Japanese Patent No. 2583074 discloses the method of performing the clustering by adding a factor of a vocalizer to phoneme environment factors. However, a feature parameter on performing the clustering is speech spectral information, which does not include prosody information such as voice pitch (fundamental frequency). This has a problem that, in the case of applying this technique to multiple speakers whose prosody information is considerably different among them, such as when creating the segment set for a male speaker and a female speaker, the clustering is performed while ignoring the prosody information, that is, not considering the prosody information applicable on the speech synthesis.

SUMMARY OF THE INVENTION

An object of the present invention is to solve at least one of the above problems.

In one aspect of the present invention, a segment set before updating is read, and clustering considering a phoneme environment is performed to it. For each cluster obtained by the clustering, a representative segment of a segment set belonging to the cluster is generated. For each cluster, a segment belonging to the cluster is replaced with the representative segment so as to update the segment set.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

FIGS. 12A and 12B are diagrams showing examples of a feature vector including speech spectral information and prosody information according to a fifth embodiment;

FIG. 21 is a diagram showing an example of a phoneme label conversion rule according to the sixth embodiment;

FIG. 22 is a diagram showing an example of a prosody label conversion rule according to the sixth embodiment;

DETAILED DESCRIPTION OF THE PREFERRED EMBODIMENTS

Preferred embodiment(s) of the present invention will be described in detail in accordance with the accompanying drawings. The present invention is not limited by the disclosure of the embodiments and all combinations of the features described in the embodiments are not always indispensable to solving means of the present invention.

First Embodiment

Figure 1:
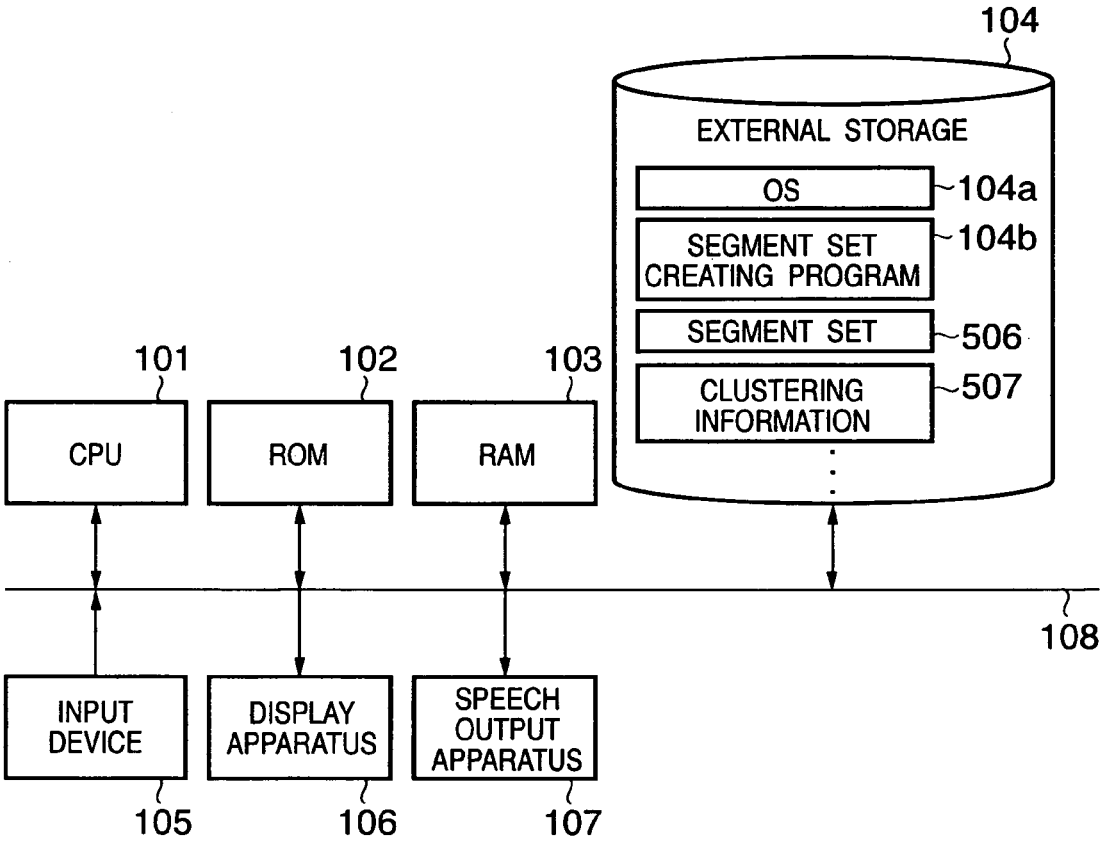
FIG. 1 is a block diagram showing a hardware configuration of a segment set creating apparatus according to an embodiment.

FIG. 1 is a block diagram showing a hardware configuration of a segment set creating apparatus according to this embodiment. This segment set creating apparatus can be typically implemented by a computer system (information processing apparatus) such as a personal computer.

Reference numeral 101 denotes a CPU for controlling the entire apparatus, which executes various programs loaded into an RAM 103 from an ROM 102 or an external storage 104. The ROM 102 has various parameters and control programs executed by the CPU 101 stored therein. The RAM 103 provides a work area on execution of various kinds of control by the CPU 101, and stores various programs to be executed by the CPU 101 as a main storage.

Reference numeral 104 denotes the external storage, such as a hard disk, a CD-ROM, a DVD-ROM or a memory card. In the case where the external storage is a hard disk, the programs and data stored in the CD-ROM or the DVD-ROM are installed. The external storage 104 has an OS 104*a*, a segment set creating program 104*b* for implementing a segment set creating process, a segment set 506 registered in advance and clustering information 507 described later stored therein.

Reference numeral 105 denotes an input device by means of a keyboard, a mouse, a pen, a microphone or a touch panel, which performs an input relating to setting of process contents. Reference numeral 106 denotes a display apparatus such as a CRT or a liquid crystal display, which performs a display and an output relating to the setting and input of process contents. Reference numeral 107 denotes a speech output apparatus such as a speaker, which performs the output of a speech and a synthetic sound relating to the setting and input of process contents. Reference numeral 108 denotes a bus for connecting the units. A segment set before or after updating as a subject of the segment set creating process may be either held in 104 as described above or held in an external device connected to a network.

Figure 2:
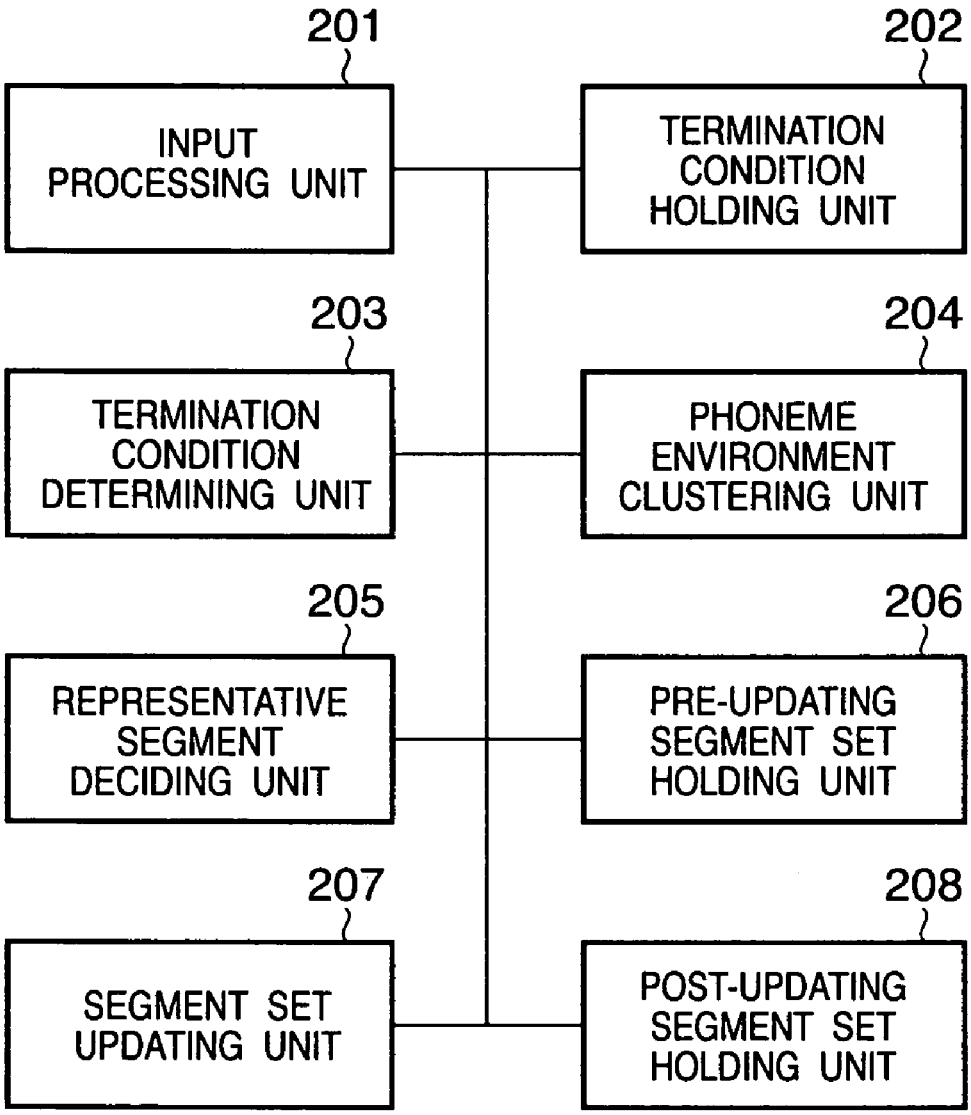
FIG. 2 is a block diagram showing a module configuration of a segment set creating program according to a first embodiment.

FIG. 2 is a block diagram showing a module configuration of a segment set creating program 104*a*.

Reference numeral 201 denotes an input processing unit for processing the data inputted via the input device 105.

Reference numeral 202 denotes a termination condition holding unit for holding a termination condition received by the input processing unit 201.

Reference numeral 203 denotes a termination condition determining unit for determining whether or not a current state-meets the termination condition.

Reference numeral 204 denotes a phoneme environment clustering unit for performing clustering considering a phoneme environment to the segment set before updating.

Reference numeral 205 denotes a representative segment deciding unit for deciding a representative segment to be used as the segment set after updating from a result of the phoneme environment clustering unit 204.

Reference numeral 206 denotes a pre-updating segment set holding unit for holding the segment set before updating.

Reference numeral 207 denotes a segment set updating unit for updating the representative segment decided by the representative segment deciding unit 205 as a new segment set.

Reference numeral 208 denotes a post-updating segment set holding unit for holding the segment set updated by the segment set updating unit 207.

The segment set creating process according to this embodiment first performs a phoneme environment clustering to a segment set (first segment set) which is a set of speech segments for speech synthesis prepared in advance, decides the representative segment from each cluster. And, a segment set (second segment set) in a smaller size is created based on the representative segment.

As for kinds of segment sets, they can be roughly divided into the segment set of which speech segment is a data structure including feature parameters representing speech spectra such as a cepstrum, an LPC and an LSP used for the speech synthesis based on source-filter models, and the segment set of which speech segment is a speech waveform itself used for the speech synthesis based on waveform processing. The present invention is applicable to either segment set. Hereunder, the process dependent on the kind of segment sets will be described each time.

When deciding the representative segment, there are two approaches of generating a centroid segment as the representative segment from the segment set included in each cluster (centroid segment generating method); and selecting the representative segment from the segment set included in each cluster (representative segment selecting method). This embodiment will describe the former centroid segment generating method, and the latter representative segment selecting method will be described by the second embodiment described later.

Figure 5:
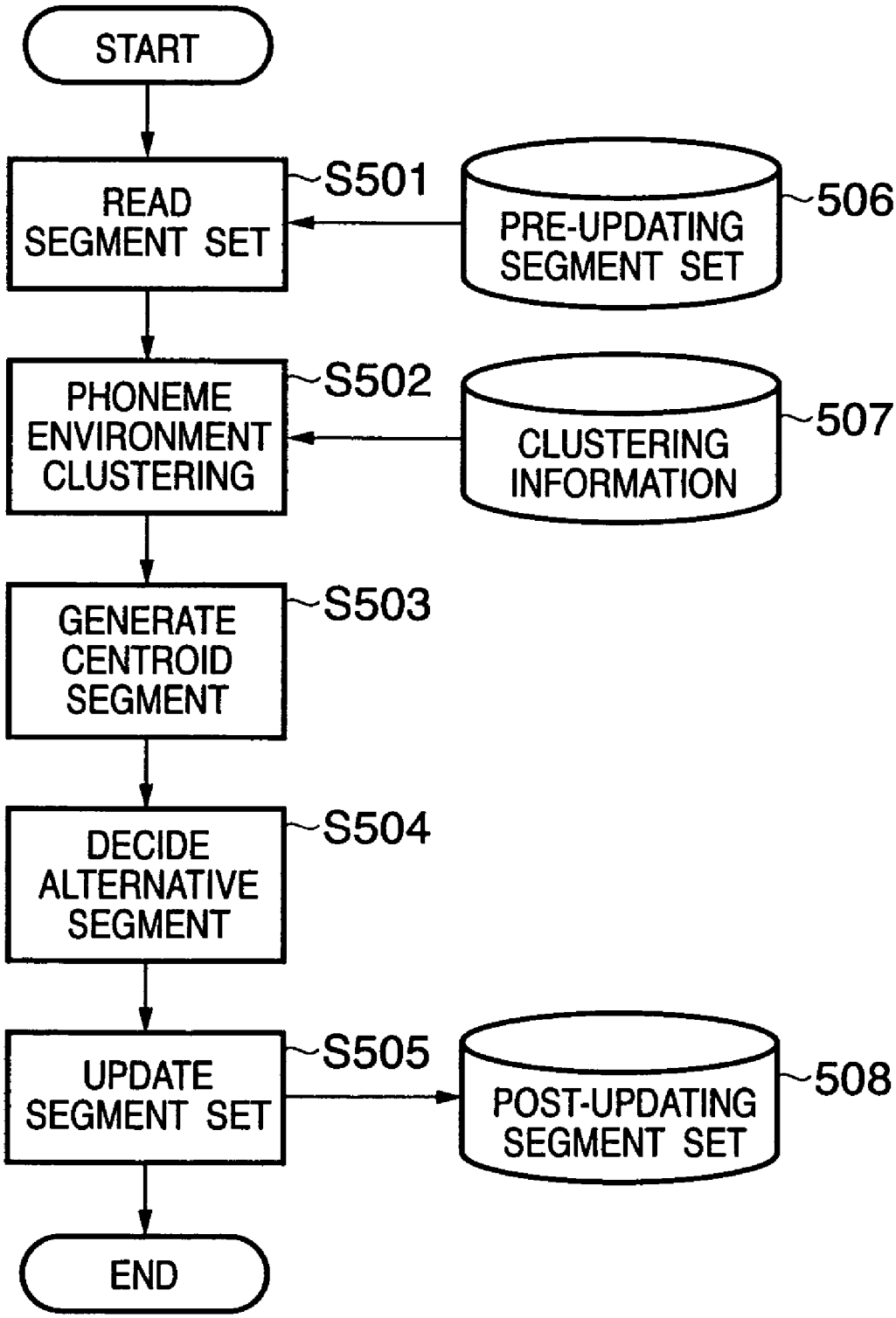
FIG. 5 is a flowchart showing a segment creating process by a centroid segment generating method according to the first embodiment.

FIG. 5 is a flowchart showing a segment creating process by the centroid segment generating method according to this embodiment.

First, in a step S501, the segment set to be processed (pre-updating segment set 506) is read from the pre-updating segment set holding unit 206. While the pre-updating segment set 506 may use various units such as a triphone, a biphone, a diphone, a syllable and a phoneme or use these units together, the case where the triphone is the unit of the segment set will be described hereunder. The number of triphones is different according to the language and definition of the phoneme. There are about 3,000 kinds of triphones existing in Japanese. Here, the pre-updating segment set 506 does not necessarily have to include the speech segments of all the triphones, but it may be the segment set having a portion of the triphones shared with other triphones. The pre-updating segment set 506 may be created by using any method. According to this embodiment, the concatenation distortion between the speech segments is not explicitly considered on clustering. Therefore, it is desirable that the pre-updating segment set 506 is created by a technique considering the concatenation distortion.

Next, in a step S502, the information necessary to perform the clustering considering the phoneme environment (clustering information 507) is read, and the clustering considering the phoneme environment is performed to the pre-updating segment set 506. A decision tree may be used for the clustering information for instance.

Figure 3:
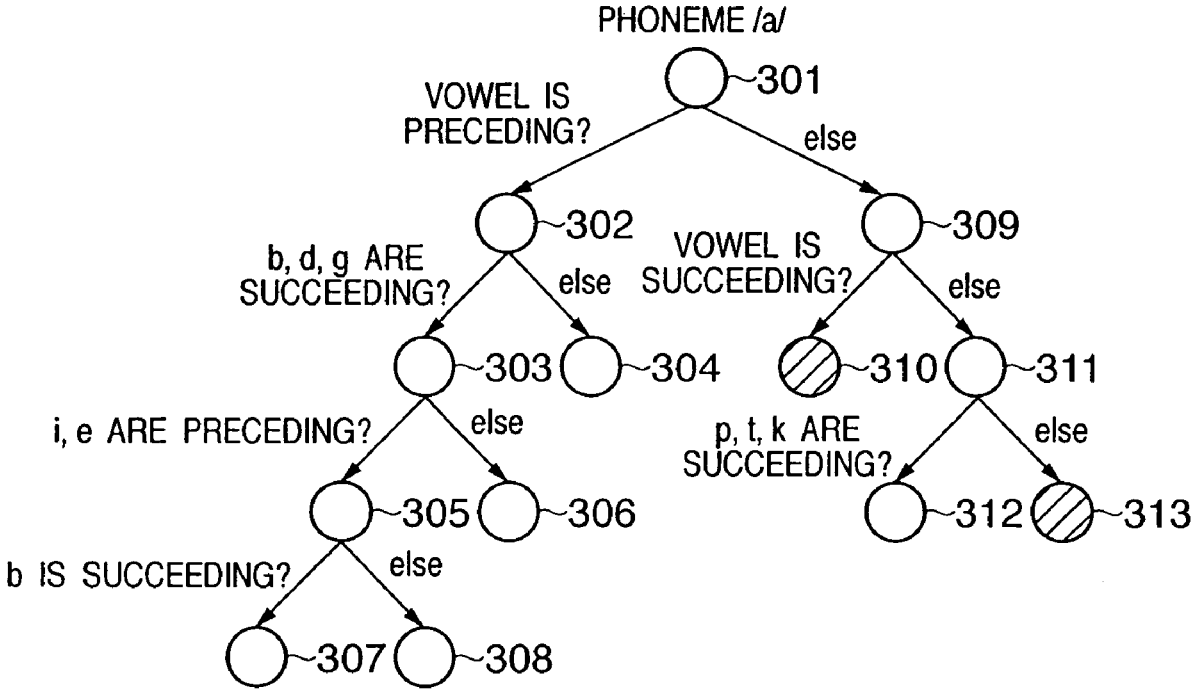
FIG. 3 is a diagram showing an example of a decision tree used for clustering considering a phoneme environment according to the first embodiment.

FIG. 3 shows an example of the decision tree used on performing the clustering considering the phoneme environment. This tree is a tree in the case where the phoneme (central phoneme of the triphone) is /a/, and the speech segments of which phoneme is /a/ are clustered by using this decision tree in the triphone of the pre-updating segment set. On a node of reference numeral 301, the clustering is performed by a question of "whether or not a preceding phoneme is a vowel." For instance, the speech segments which are "vowel-a+*" (a−a+k or u−a+o for instance) are clustered on a node of reference numeral 302, and the speech segments which are "consonant-a+*" (k−a+k or b−a+o for instance) are clustered on a node of reference numeral 309. Here, "−" and "+" are signs representing a preceding environment and succeeding environment respectively. As for u−a+o, it signifies the speech segment of which preceding phoneme is u, phoneme is a, and succeeding phoneme is o.

Figure 4:
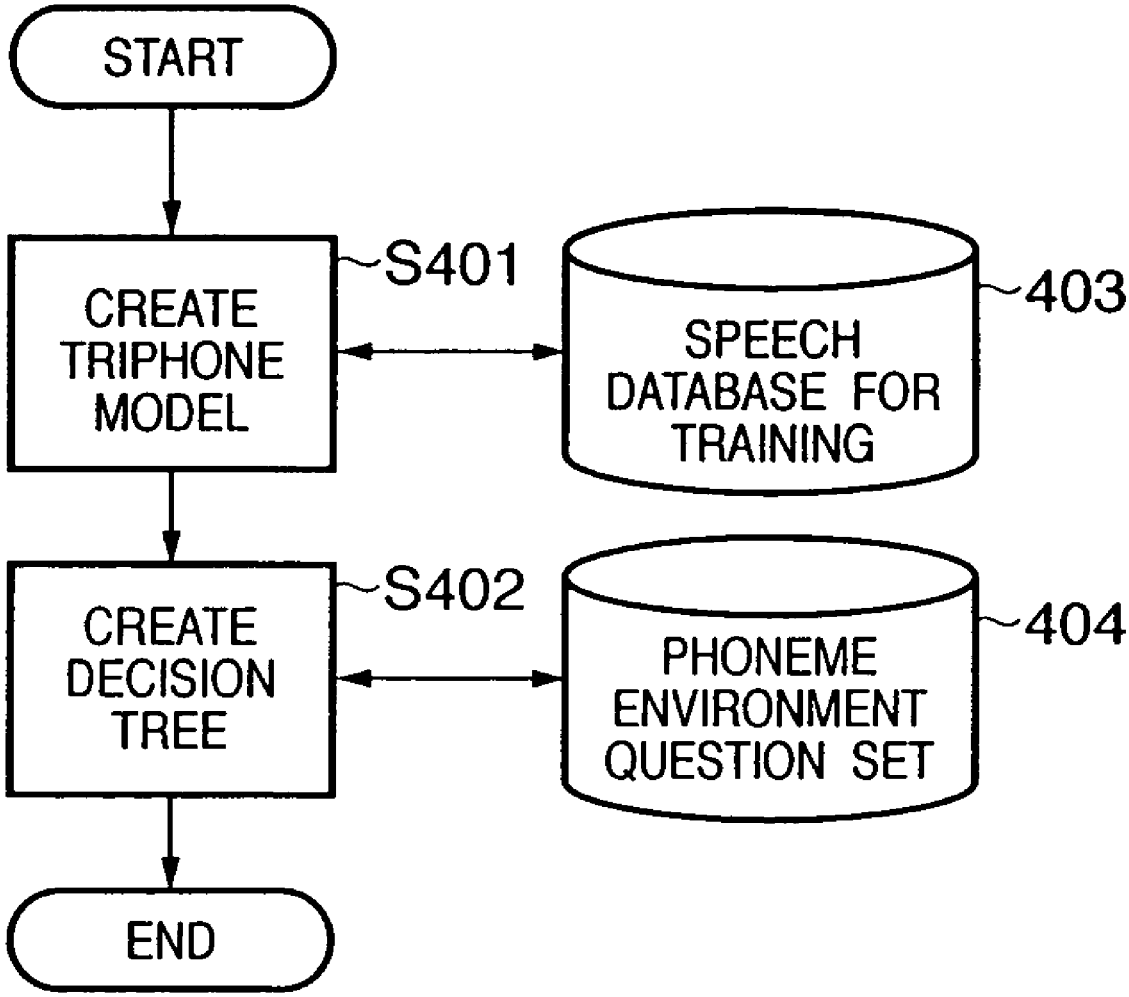
FIG. 4 is a flowchart showing a process for creating the decision tree used for the clustering considering the phoneme environment according to the first embodiment.

Hereafter, the clustering is performed likewise according to the questions on intermediate nodes 302, 303, 305, 309 and 311 so as to acquire speech segment sets belonging to each cluster on leaf nodes 304, 306, 307, 308, 310, 312 and 313. For instance, two kinds of segment sets of "i−a+b" and "e−a+b" belong to the cluster 307, and four kinds of segment sets of "i−a+d," "i−a+g" "e−a+d" and "e−a+g" belong to the cluster 308. The clustering is also performed to other phonemes by using the similar decision trees. Here, the decision tree of FIG. 3 includes the questions relating to phonologically similar (identifiable) phoneme sets, not a phoneme, such as the "vowels," "b, d, g" and "p, t, k." FIG. 4 shows a procedure for creating such a decision tree.

First, in a step S401, a triphone model is created from a speech database for training 403 including speech feature parameters and phoneme labels for it. For instance, the triphone models can create triphone HMMs by using the technique of the hidden Markov model (HMM) widely used for speech recognition.

Next, in a step S402, a question set 404 relating to the phoneme environment prepared in advance is used to apply a clustering standard such as a maximum likelihood criterion for instance so as to perform the clustering starting from the question set satisfying the clustering criterion best. Here, the phoneme environment question set 404 may use any questions as long as those about the phonologically similar phoneme sets are included. A termination of the clustering is set by the input processing unit 201 and so on, and is determined by the termination condition determining unit 203 by using the clustering termination condition stored in the termination condition holding unit 202. A termination determination is individually performed to all the leaf nodes. It is usable as the termination condition, for instance, that no significant difference is observed before and after the clustering of the leaf nodes in the case where the number of samples of the speech segment sets included in the leaf nodes becomes less than a predetermined number (or, in the case where the difference in total likelihood before and after the clustering becomes less than a predetermined value). The above decision tree creating procedure is simultaneously applied to all the phonemes so as to create the decision tree considering the phoneme environment as shown in FIG. 3 for all the phonemes.

A description will be given by returning to the flowchart of FIG. 5.

Next, in a step S503, the centroid segment as the representative segment is generated from the segment set belonging to each cluster. The centroid segment may be generated for either the speech synthesis based on source-filter models or the speech synthesis based on waveform processing. Hereafter, a description will be given by using FIGS. 6 and 7 as to the method of generating the centroid segment according to each of the methods.

Figures 6A, 6B, 6C, 6D, 6E, 6F, 6G, 6H, 6I:
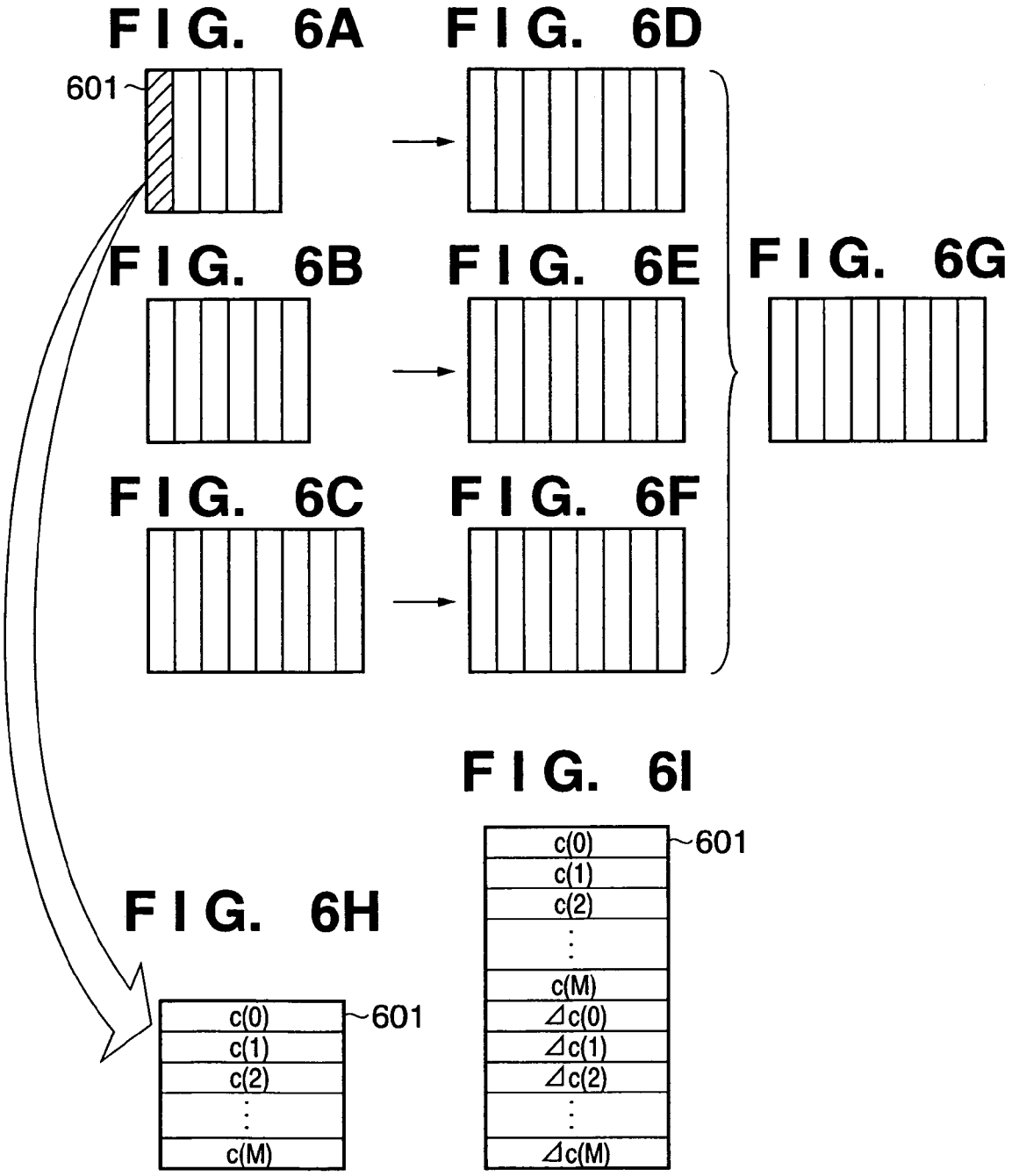
FIGS. 6A to 6I are diagrams for describing the centroid segment generating method by a speech synthesis based on source-filter models.

FIGS. 6A to 6I are schematic diagrams showing examples of the centroid segment generating method by the speech synthesis based on source-filter models. There are three segment sets of FIGS. 6A to 6C as the segment sets belonging to a certain cluster. Here, FIG. 6A shows a speech segment consisting of a feature parameter sequence of five frames. Likewise, FIGS. 6B and 6C are speech segments consisting of feature parameter sequences of six frames and eight frames. Here, a feature parameter 601 of one frame (a hatching portion of FIG. 6A) is a feature vector of a speech of the data structure as shown in FIG. 6H or 6I. For instance, the feature vector of FIG. 6H consists of cepstrum coefficients c (0) to c (M) of M+1 dimension. And the feature vector of FIG. 6I consists of cepstrum coefficients c (0) to c (M) of M+1 dimension and delta coefficients Δc (0) to Δc (M) thereof.

Of the above segment set diagrams 6A to 6C, FIG. 6C has the largest number of frames, that is eight frames. Here, the numbers of frames of FIGS. 6A and 6B are increased as in FIGS. 6D and 6E so as to adjust the number of frames of each segment set to eight frames at the maximum. Any method may be used to increase the numbers of frames. It is possible, for instance, to do so by linear warping of a time axis based on the linear interpolation of the feature parameters. And FIG. 6F uses the same parameter sequence as FIG. 6C.

Next, it is possible to generate the centroid segment shown in FIG. 6G by acquiring an average of the feature parameters of the frames of FIGS. 6D to 6F. This example described the case where the feature parameters of the speech synthesis based on source-filter models is speech parameter time-series. There is also a technique, however, based on a probability model for performing the speech synthesis from a speech parameter statistic (average, variance and so on). In such a case, a statistic as the centroid segment should be calculated by using individual statistics rather than seeking averaging of the feature vectors.

Figure 7A:
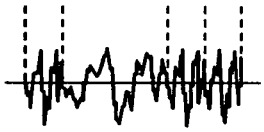
FIGS. 7A to 7G are diagrams for describing the centroid segment generating method by a speech synthesis based on waveform processing.
Figure 7B:
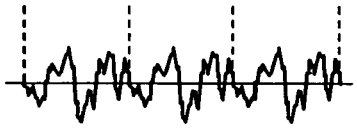
Figure 7C:
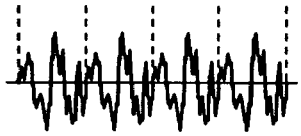

FIGS. 7A to 7G are schematic diagrams showing an example of the centroid segment generating method by the speech synthesis based on waveform processing. There are three segment sets of FIGS. 7A to 7C as those belonging to a certain cluster (a broken line represents a pitch mark position). Here, FIG. 7A is the speech segment consisting of the speech waveform of four periods. FIGS. 7B and 7C are the speech segments consisting of the speech waveforms of three pitch periods and four pitch periods respectively.

Out of these, the one having the longest time length of the segment is selected as a template for creating the centroid segment out of those having the largest number of pitch periods of the segment sets. In this example, both FIGS. 7A and 7C have four pitch periods as the largest number of the pitch periods. However, FIG. 7C has a longer time length of the segment, and so FIG. 7C is selected as the template for creating the centroid segment.

Figure 7D:
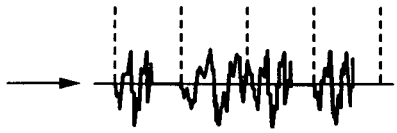
Figure 7E:
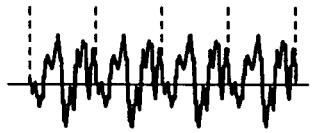
Figure 7F:
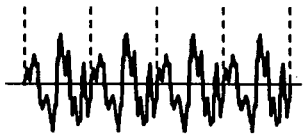

Next, FIGS. 7A and 7B are deformed as FIGS. 7D and 7E in order to have the number of pitch periods and the pitch period length of FIG. 7C respectively. Here, while any method may be used for this deformation, the method in the public domain used by PSOLA may preferably be used. FIG. 7F has the same speech waveform as FIG. 7C.

Figure 7G:
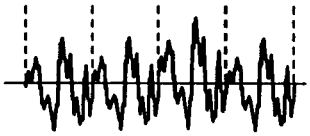

And it is possible to generate the centroid segment shown in FIG. 7G by calculating an average of the samples of FIGS. 7D to 7F.

The flowchart of FIG. 5 will be described again.

In a step S504, it is determined whether or not to replace all the speech segments belonging to each cluster with the centroid segment generated as previously described. Here, in the case where an upper limit of the size (memory, number of segments and so on) of the updated segment set is set in advance, it may become larger than a desired size if all the segment sets on the leaf nodes of the decision tree are replaced with the centroid segments. In such a case, the centroid segments should be created on the intermediate nodes which are higher than the leaf nodes by one step so as to be alternative segments. As for decision of subject leaf nodes in this case, the order in which each node was clustered is held as the information on the decision tree in creation of the decision tree in the step S402, and the procedure for creating the centroid segment on the intermediate node is repeated in reversed order thereof until it becomes a desired size.

In a subsequent step S505, the alternative segments are stored in the external storage 104 as a segment set 508 after updating so as to finish this process.

Figure 11A:
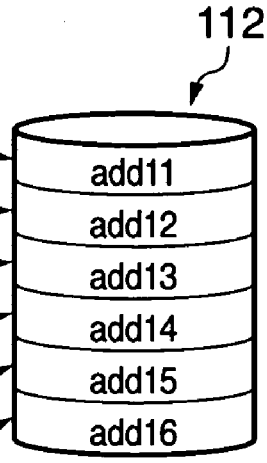
FIGS. 11A and 11B are diagrams showing examples of a segment set before updating and a segment set after updating according to the first embodiment.
Figure 11B:
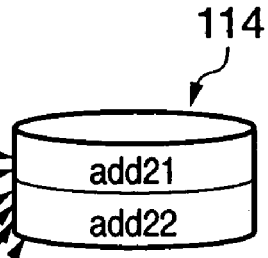

FIGS. 11A and 11B show examples of the segment set before updating and after updating respectively. Reference numeral 111 of FIGS. 11A and 113 of FIG. 11B denote segment tables, and 112 of FIG. 11A and 114 of FIG. 11B denote examples of the segment data. The respective segment tables 111 and 113 include the information on IDs, the phoneme environment (triphone environment) and start addresses having the segments stored therein, and the respective segment data has the data on the speech segments (speech feature parameter sequence, speech waveforms and so on) stored therein. As for the segment sets after updating, the two speech segments of ID=1 and ID=2 are shared by one speech segment (segment storage address add21) while the four speech segments of IDs=3 to 6 are shared by one speech segment (segment storage address add22). Thus, it is understandable that the speech segment data is reduced as a whole.

According to this embodiment, the decision tree by means of a binary tree is used as the clustering information. However, the present invention is not limited thereto but any type of decision tree may be used. Furthermore, not only the decision tree but the rules extracted from the decision tree by the techniques such as C4.5 may also be used as the clustering information.

As is clear from the above description, it is possible, according to this embodiment, to apply the clustering considering the phoneme environment having grouped identifiable phoneme sets to the segment sets created in advance so as to reduce the segment sets while suppressing degradation of sound quality.

Second Embodiment

The above-mentioned first embodiment generates the centroid segment for each cluster from the segment set belonging to the cluster (step S503) so as to render it as the representative segment. The second embodiment described hereunder selects the representative segment for each cluster highly relevant to the cluster from the segment set included in the cluster instead of generating the centroid segment (representative segment selecting method).

Figure 9:
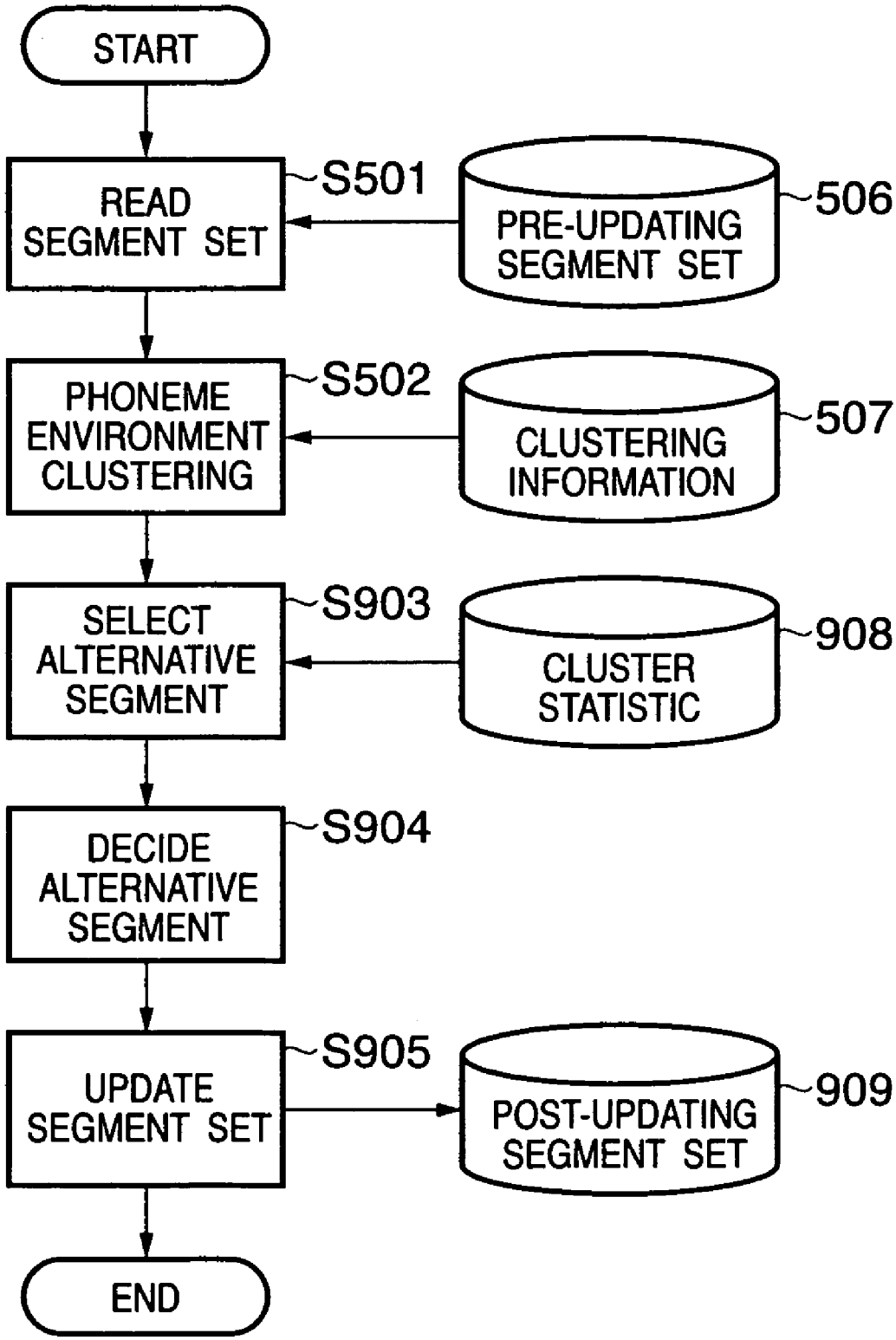
FIG. 9 is a flowchart showing a segment set creating process by a representative segment selecting method according to the second embodiment.

FIG. 9 is a flowchart showing the segment set creating process by the representative segment selecting method according to this embodiment.

First, the same processing as in the steps S501 and S502 described in the first embodiment is performed. To be more specific, in the step S501, the segment set to be processed (pre-updating segment set 506) is read from the pre-updating segment set holding unit 206. In the step S502, the clustering considering the phoneme environment is performed to the pre-updating segment set 506.

Next, in a step S903, the representative segment is selected from the segment set belonging to each cluster obtained in the step S502. As for the selection of the representative segment, there is an approach of creating the centroid segment from the segment set belonging to each cluster by the method described in the first embodiment and selecting the segment closest thereto. Hereunder, a description will be given as to a method using a cluster statistic obtained from the speech database for training.

Figure 8:
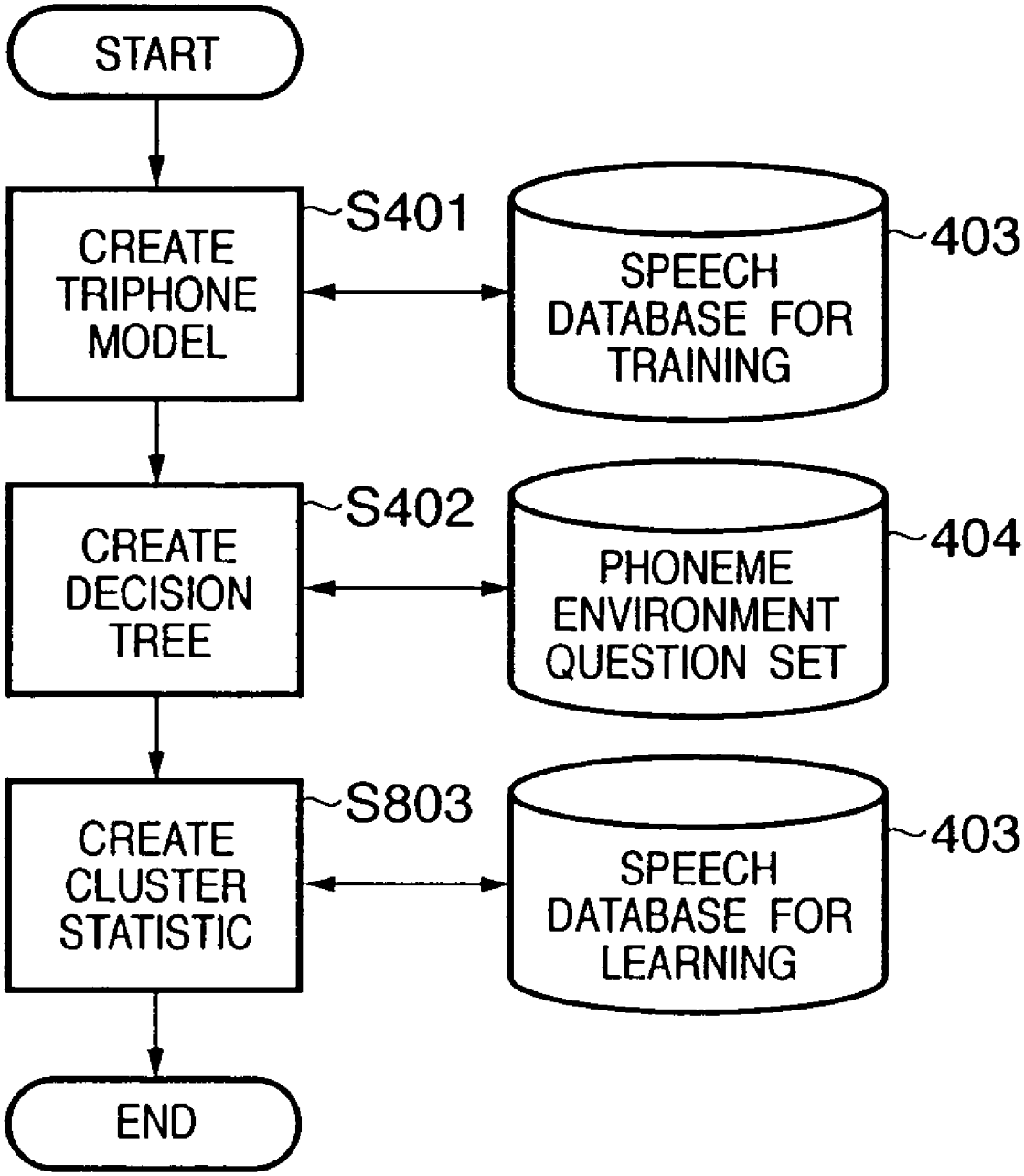
FIG. 8 is a flowchart showing a process for generating a cluster statistic according to a second embodiment.

FIG. 8 is a flowchart showing the process for generating the cluster statistic according to this embodiment.

First, the same processing as in the steps S401 and S402 described in the first embodiment is performed. To be more specific, in the step S401, the triphone model is created from the speech database for training 403 including the speech feature parameters and phoneme label for it. Next, in the step S402, the question set 404 relating to the phoneme environment prepared in advance is used to apply the clustering standard such as the maximum likelihood rule for instance so as to perform the clustering starting from the question set satisfying the clustering standard best. The decision tree considering the phoneme environment is created for all the phonemes by the process in the steps S401 and S402.

Next, in a step S803, the phoneme label of the triphone is converted to the phoneme label of a shared triphone by using shared information on the triphone obtained from the decision tree created in the step S402. As for 307 of FIG. 3 for instance, two kinds of triphone label of "i–a+b" and "e–a+b" are converted together to a shared triphone label of "ie–a+b." Thereafter, a shared triphone model is created from the speech database for training 403 including the phoneme label and corresponding speech feature parameters to render the statistic of this model as the cluster statistic. For instance, in the case of creating the shared triphone model as a single distribution continuous HMM (3-state model for instance), the cluster statistic is the average and variance of a speech feature vector in each state and a transition probability among the states. The cluster statistic generated as above is held by the external storage 104 as a cluster statistic 908.

The flowchart of FIG. 9 will be described again.

In the step S903, the segment highly relevant to the cluster is selected from the segment set by using the cluster statistic 908. As for a method of calculating a relevance ratio, it is possible, in the case of using the HMM for instance, to select the speech segment having the highest likelihood for the cluster HMM.

Figure 10:
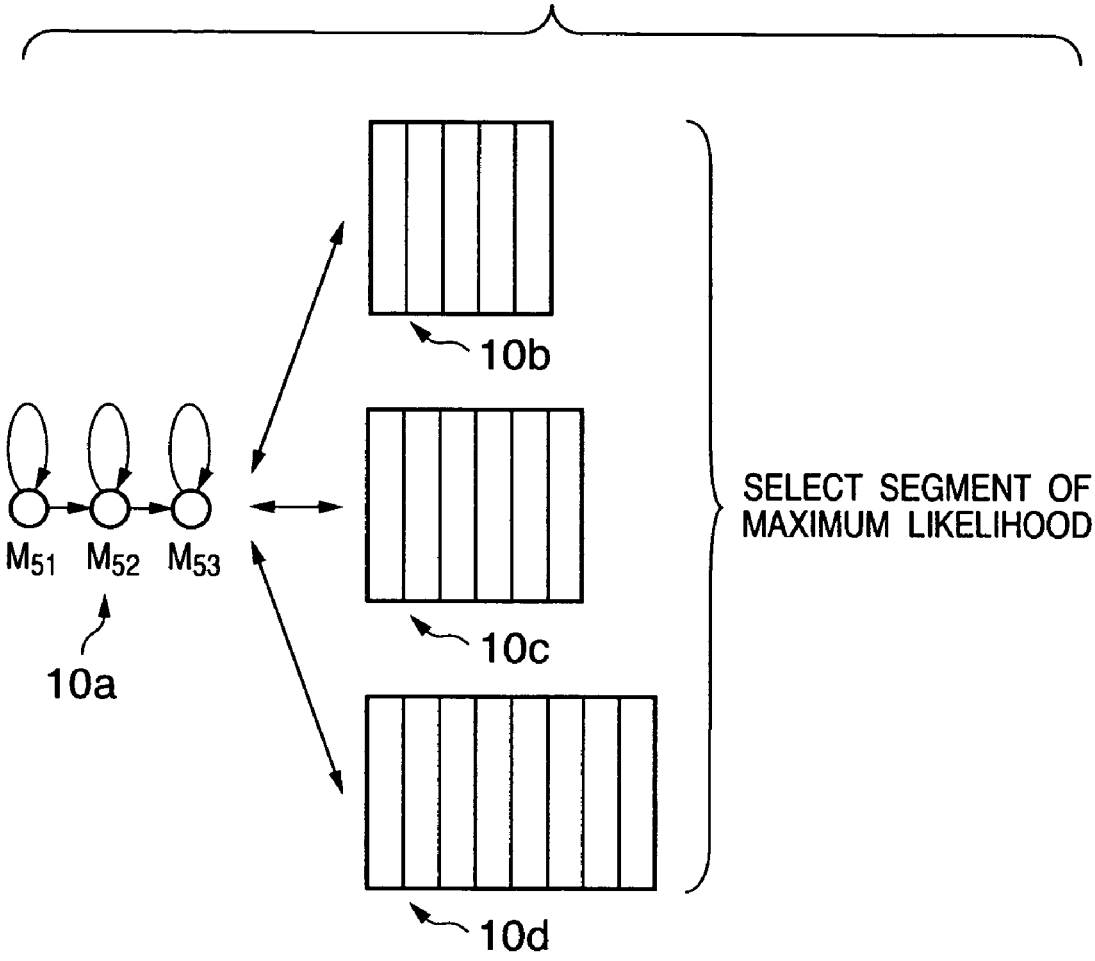
FIG. 10 is a diagram showing the representative segment selecting method by the speech synthesis based on source-filter models.

FIG. 10 is a diagram for describing the representative segment selecting method of the speech synthesis based on source-filter models.

Reference numeral 10*a* denotes the three state HMMs holding the cluster statistics (average, variance and transition probability) consisting of $M_{S1}$, $M_{S2}$ and $M_{S3}$ to each state. Now, there are three segment sets 10*b*, 10*c* and 10*d* belonging to a certain cluster. As for the likelihood of 10*b* against 10*a* in this case, the likelihood (or log likelihood) of the segment 10*b* can be calculated by the Viterbi algorithm used in the field of speech recognition. The likelihood is calculated likewise as to 10*c* and 10*d* so as to render the segment of the highest likelihood of the three as the representative segment. When calculating the likelihood, it is desirable, as the number of frames is different, to compare them by a normalized likelihood whereby each likelihood is divided by the number of frames.

The flowchart of FIG. 9 will be described again.

In a step S904, it is determined whether or not to replace all the speech segments belonging to each cluster with the representative segment selected as previously described. Here, in the case where the upper limit of the size (memory, number of segments and so on) of the updated segment set is set in advance, it may become larger than a desired size if all the segment sets on the leaf nodes of the decision tree are replaced with the representative segments. In such a case, the representative segments on the intermediate nodes higher than the leaf nodes by one step should be selected so as to render them as the alternative segments. As for decision of the subject leaf nodes in this case, the order in which each node was clustered is held as the information on the decision tree in the creation of the decision tree in the step S402, and the procedure for selecting the representative segment on the intermediate node is repeated in reversed order thereof until it becomes a desired size. In this case, it is necessary to hold the statistic on the intermediate nodes in the cluster statistic 908.

In a subsequent step S905, the alternative segments are stored in the external storage 104 as a segment set 909 after updating. Or else, a segment set 505 before updating having the segment data other than the alternative segments deleted therefrom is stored in the external storage 104 as the segment set 909 after updating. This process is finished thereafter.

The above described the representative segment selecting method of the speech synthesis based on source-filter models. As for the speech synthesis based on waveform processing, it is possible to apply the aforementioned method once the feature parameter is represented by performing a speech analysis to the speech segments. And the speech segments corresponding to the selected feature parameter sequence should be rendered as the representative segments.

Third Embodiment

According to the above-mentioned first and second embodiments, the clustering considering the phoneme environment was performed to the triphone model. However, the present invention is not limited thereto but more detailed clustering may be performed. To be more precise, it is possible, in the creation of the decision tree in the step S402, to create the decision tree for each state of the triphone HMM rather than for the entirety of the triphone HMM. In the case of using a different decision tree for each state, it is necessary to divide the speech segments to be assigned to each state. Any method may be used for assignment to each state. To do so easily, however, they may be assigned by the linearwarping.

It is also possible to create the decision tree relating to the state most influenced by the phoneme environment (portions of entering and exiting of the phonemes in the case of the diphone for instance) so as to apply this decision tree to another state (portions connected to the same phoneme in the case of the diphone for instance).

Fourth Embodiment

Although not specified, the above-mentioned embodiments are basically on the assumption that the segment set is one speaker. However, the present invention is not limited thereto but is also applicable to the segment set consisting of multiple speakers. In this case, however, it is necessary to consider the speakers as a phoneme environment. To be more precise, a speaker-dependent triphone model is created in the step S401, questions about the speakers are added to the question set 404 relating to the phoneme environment, and the decision tree including the speaker information is created in the step S402.

Figure 17:
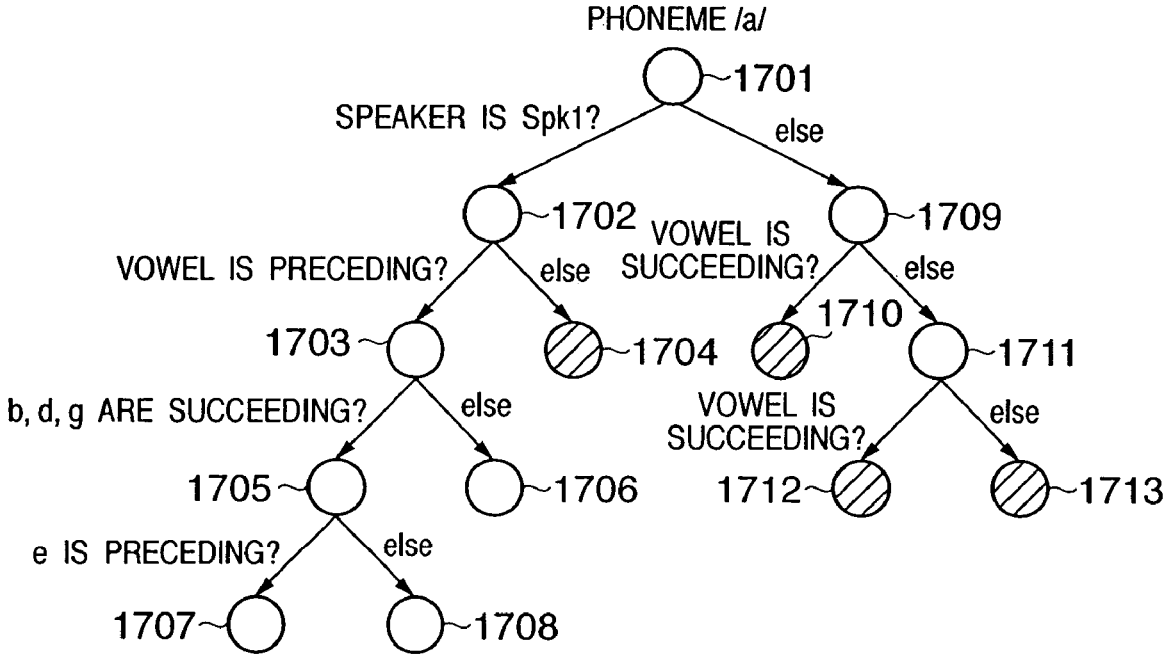
FIGS. 17 and 18 are diagrams showing examples of the decision tree used on performing the clustering considering a phoneme environment and a speaker as a phonological environment according to a fourth embodiment.
Figure 18:
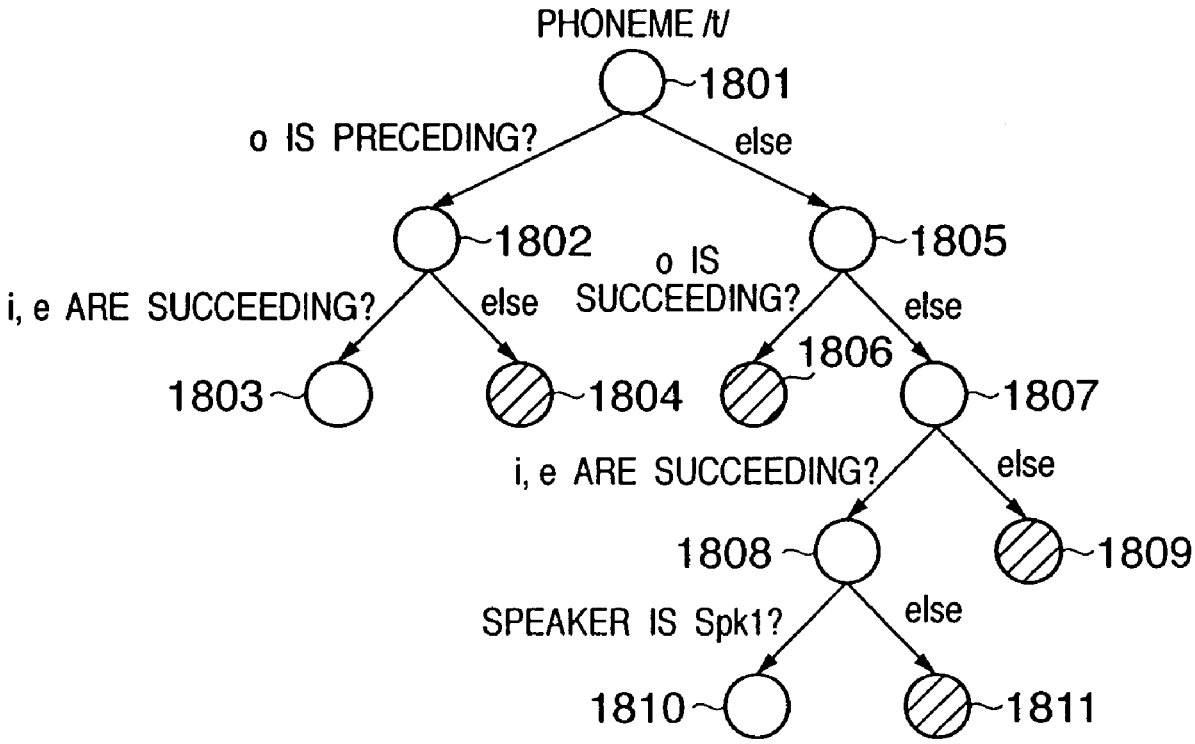
Figure 19:
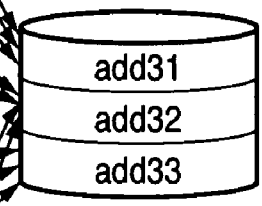
FIG. 19 is a diagram showing an example of the segment sets before updating and the segment sets after updating according to the fourth embodiment.

FIGS. 17 (in the case where the phoneme is /a/) and 18 (in the case where the phoneme is /t/) show examples of the decision tree used on performing the clustering considering the phoneme environment and speakers as a phonological environment. FIG. 19 shows an example of the segment sets after updating as against the segment sets of multiple speakers. As is understandable from FIG. 19, a common speech segment is used for multiple speakers (segment of add32) according to this embodiment, which allows more efficient segment sets to be created than the case of individually creating the post-updating segment set for each speaker.

Fifth Embodiment

The above-mentioned fourth embodiment showed that the present invention is also applicable to the segment set of multiple speakers by considering the speakers as the phoneme environment.

As described by referring to FIG. 6H or 6I, the first embodiment described the example using the cepstrum coefficient as the feature parameters of the speech on creating the clustering information. It is nevertheless possible to use other speech spectral information such as the LPC or LSP instead of the cepstrum coefficient. It should be noted, however, that the speech spectral information includes no information on a fundamental frequency. Therefore, even if the speakers are considered as the phoneme environment in the case of clustering the segment set consisting of a male speaker and a female speaker for instance, the clustering is performed by noting only the difference in the speech spectral information when using the clustering information created without including fundamental frequency information. To be more specific, there is a possibility that a segment of a vowel of the male may be shared with a segment of a vowel of the female, and there is consequently a problem that degradation of sound quality occurs. To prevent such a problem, it is necessary to use prosody information such as the fundamental frequency when creating the clustering information.

FIGS. 12A and 12B are diagrams showing examples of the feature vectors including the speech spectral information and prosody information. FIG. 12A shows the example of the feature vectors having three kinds of the prosody information of a logarithmic fundamental frequency (F0), a log value of waveform power (power) and phoneme duration (duration) in addition to M+1 dimension spectral information (cepstrum c(0) to c(M)). FIG. 12B shows the feature vectors having their respective delta coefficients in addition to the information of FIG. 12A. The duration of the phoneme may be used as the duration. It is not essential to use all of F0, power and duration. An arbitrary combination thereof may be used, such as not using c(0) when using power for instance, or other prosody information may be used. A special value such as −1 may be used as the value of F0 for unvoiced sound. It is also possible not to use F0 for the unvoiced sound (that is, the number of dimensions thereof becomes smaller than the voiced sound).

As for the segment data configured by the feature vectors including such prosody information, consideration is given hereunder as to application to the first embodiment (the method of generating the centroid segment and rendering it as the representative segment) and the second embodiment (the method of selecting the representative segment from the segment set included in each cluster).

Figure 13:
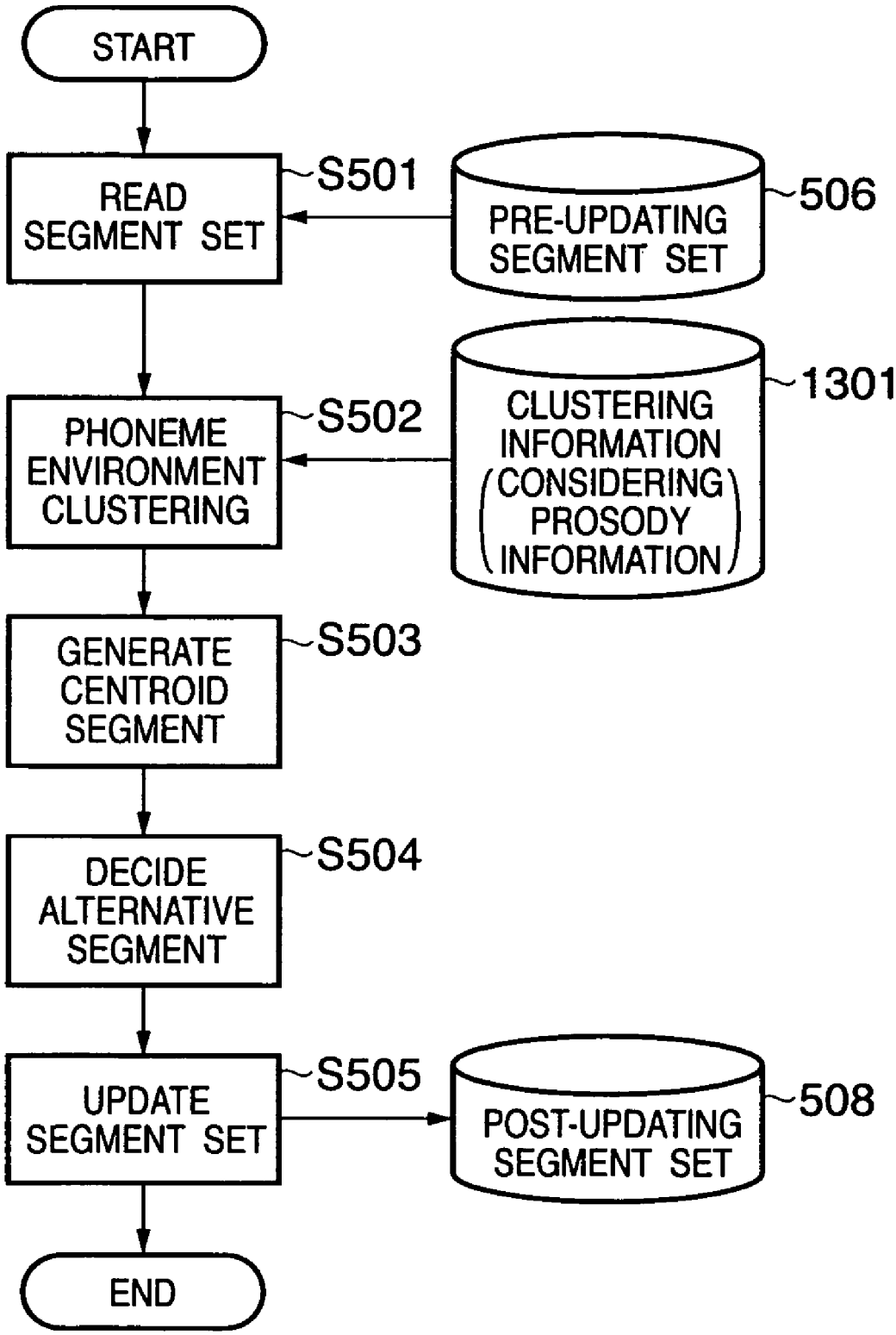
FIG. 13 is a flowchart showing the segment set creating process by the centroid segment generating method according to the fifth embodiment.

First, the application to the first embodiment will be described. FIG. 13 is a flowchart showing the segment set creating process by the centroid segment generating method according to this embodiment. This processing flow is basically the same as the flow shown in FIG. 5. However, it is different in that the clustering information used in the step S502 is clustering information 1301 created by considering the prosody information.

Figure 14:
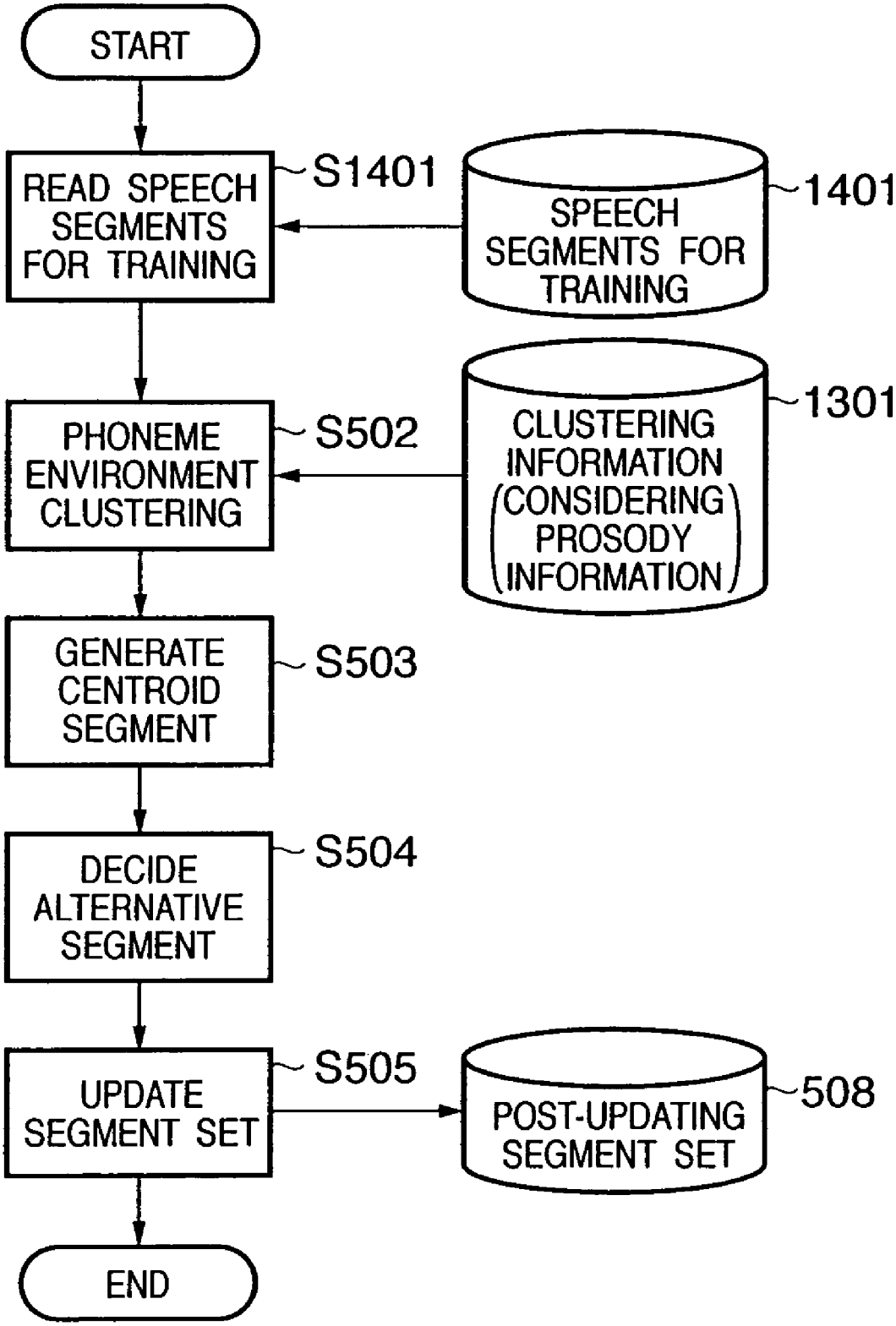
FIG. 14 is a flowchart showing another example of the segment set creating process by the centroid segment generating method according to the fifth embodiment.

FIG. 14 is a flowchart showing another example of the segment set creating process by the centroid segment generating method. Here, speech segments for training 1401 including the speech spectral information and prosody information in their feature parameters are read (step S1401) instead of the step S501. In the next step S502, the phoneme environment clustering is performed to the speech segments for training 1401. It is different from FIG. 13 in that the step S1401 replacing the step S501 is the process for the entire speech segments for training rather than the process intended for the segment sets.

Figure 15:
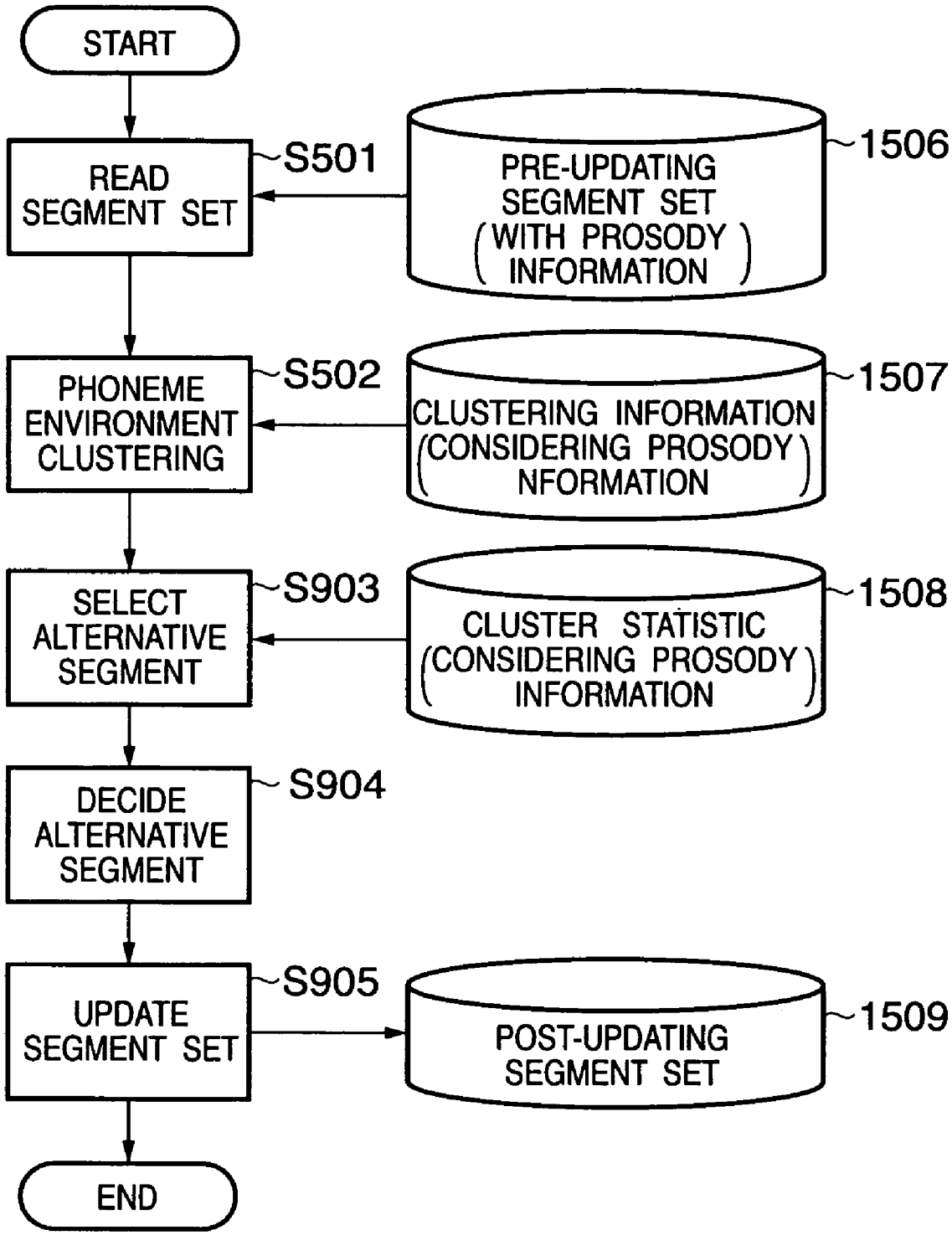
FIG. 15 is a flowchart showing the segment set creating process by the representative segment selecting method according to the fifth embodiment.

Next, the application to the second embodiment will be described. FIG. 15 is a flowchart showing the segment set creating process by the representative segment selecting method according to this embodiment. This processing flow is basically the same as the flow shown in FIG. 9. However, it is different in that the pre-updating segment set used in the step S501 is a segment set 1506 having the prosody information provided thereto, the clustering information used in the step S502 is clustering information 1507 created by considering the prosody information, and the cluster statistic used in the step S903 is a cluster statistic 1508 including the prosody information.

Figure 16:
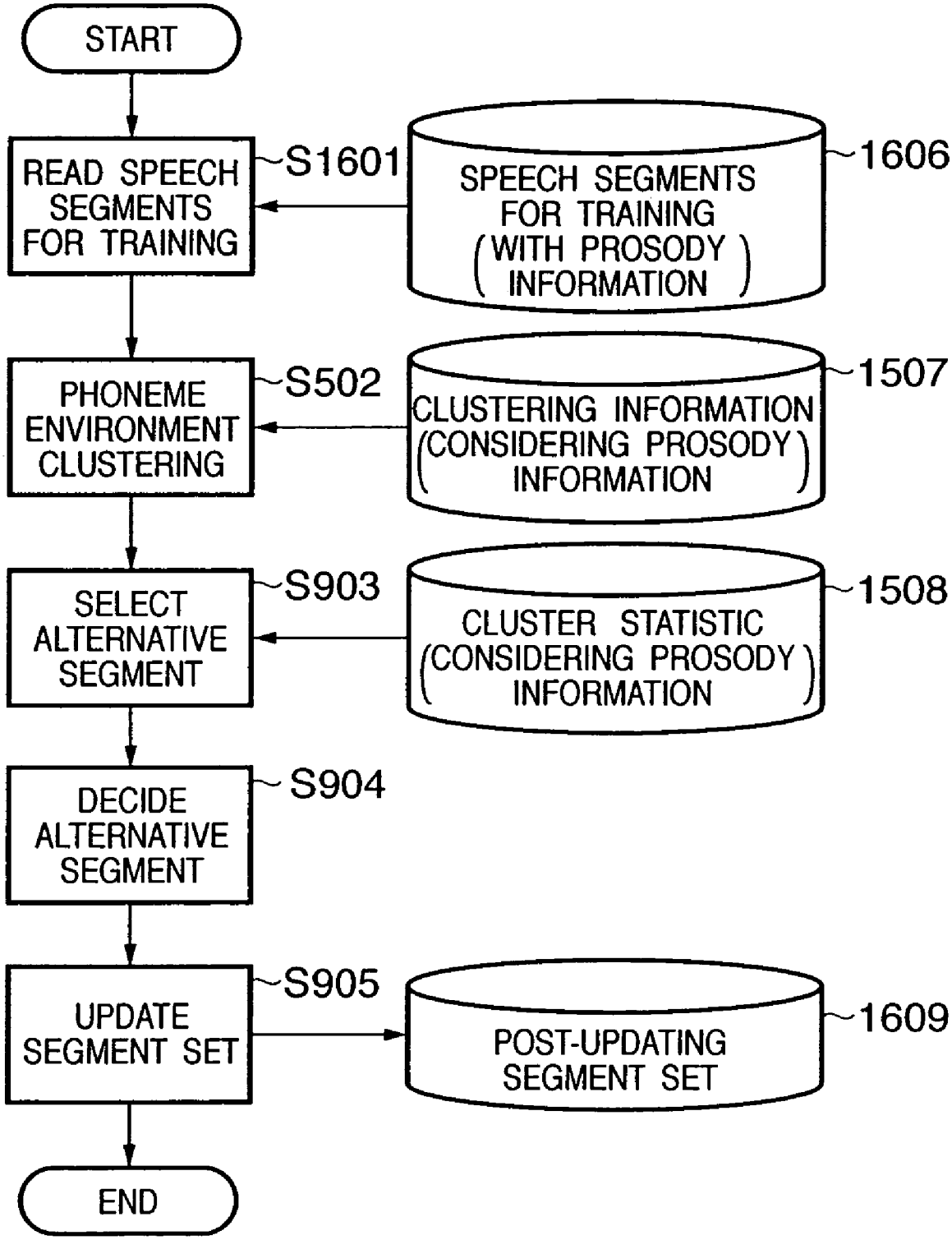
FIG. 16 is a flowchart showing another example of the segment set creating process by the representative segment selecting method according to the fifth embodiment.

FIG. 16 is a flowchart showing another example of the segment set creating process by the representative segment selecting method according to this embodiment. Here, speech segments for training 1606 including the speech spectral information and prosody information in their feature parameters are read (step S1601) instead of the step S501. In the next step S502, the phoneme environment clustering is performed to the speech segments for training 1606. It is different from FIG. 15 in that the step S1601 replacing the step S501 is the process for the entire speech segments for training rather than the process intended for the segment sets.

According to the fifth embodiment described above, the prosody information such as the fundamental frequency is used when clustering, and so it is possible to avoid an inconvenience that a segment of a vowel of the male is shared with a segment of a vowel of the female for instance.

Sixth Embodiment

Although not specified, the above-mentioned embodiments are basically on the assumption that the segment set is one language. However, the present invention is not limited thereto but is also applicable to the segment set consisting of multiple languages.

Figure 20:
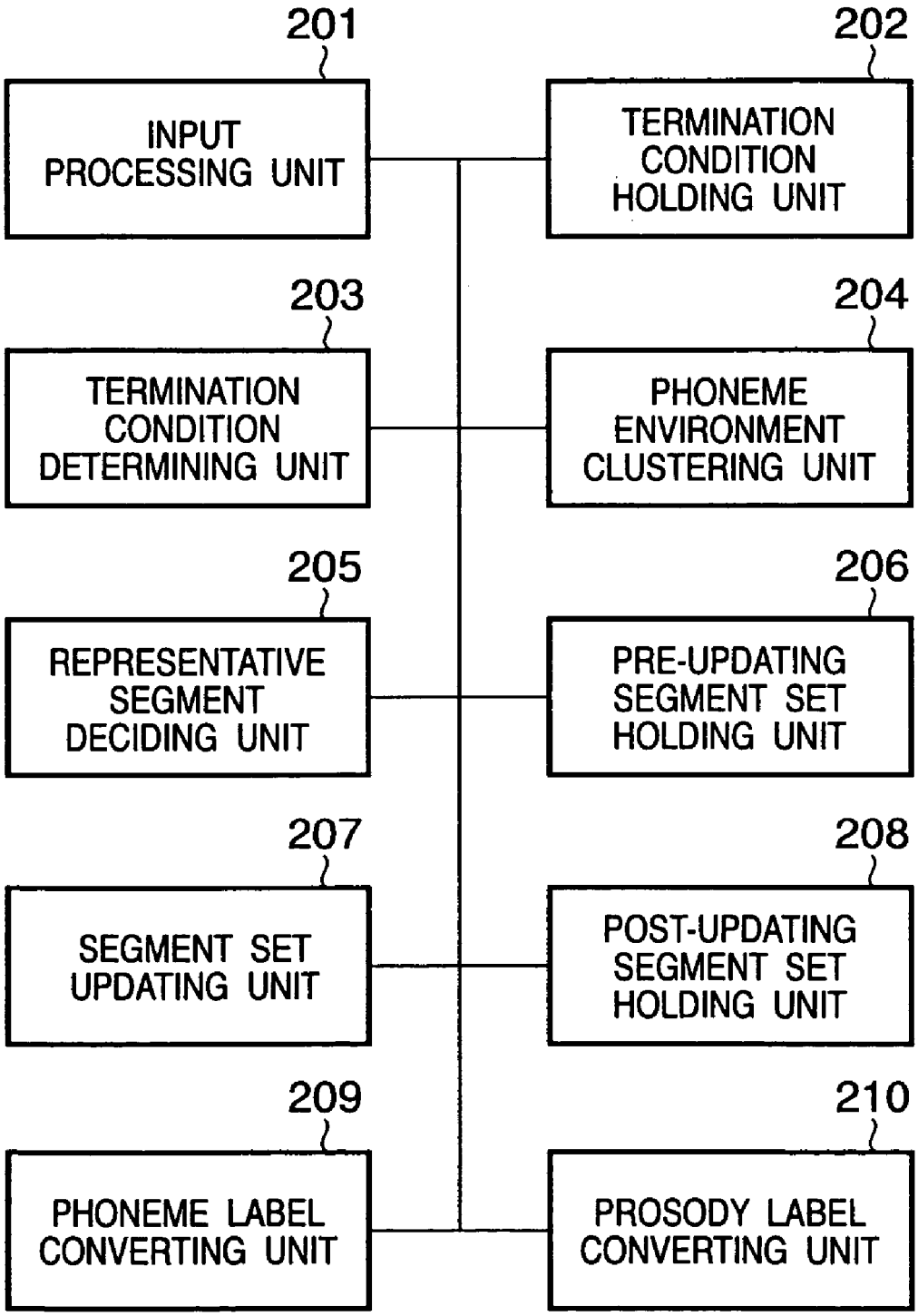
FIG. 20 is a block diagram showing a module configuration of the segment set creating program according to a sixth embodiment.

FIG. 20 is a block diagram showing a module configuration of the segment set creating program 104*a* according to this embodiment.

As is understandable by comparing it with FIG. 2, the configuration shown in FIG. 20 is the configuration of FIG. 2 having a phoneme label converting unit 209 and a prosody label converting unit 210 added thereto. The phoneme label converting unit 209 converts phoneme label sets defined in languages to one kind of phoneme label sets. The prosody label converting unit 210 converts prosody label sets defined in the languages to one kind of prosody label sets.

The following describes the case of using both the phoneme label converting unit 209 and prosody label converting unit 210. In the case of using the speech segment not considering the prosody label, the process using only the phoneme label converting unit 209 should be performed.

FIG. 21 shows an example of a phoneme label conversion rule relating to three languages of Japanese, English and Chinese. Here, the phoneme labels before conversion and the languages thereof are listed in a first column, and the phoneme labels after conversion are listed in a second column. Such a phoneme label conversion rule may be either created manually or created automatically according to a criterion such as a degree of similarity of the speech spectral information. In this example, the phoneme environment before and after the conversion is not considered. It is also possible, however, to perform more detailed phoneme label conversion by considering the phoneme environment before and after it.

FIG. 22 shows an example of a prosody label conversion rule relating to the three languages of Japanese, English and Chinese. Here, the prosody labels before conversion and the languages thereof are listed in the first column, and the prosody labels after conversion are listed in the second column. There are the cases where, to implement high-quality speech synthesis, the prosody label conversion rule uses the segment sets dependent on existence or nonexistence of accent nucleus in the case of Japanese, differences in stress levels in the case of English, and four tones in the case of Chinese. To apply the present invention to such segment sets of multiple languages, it is necessary to convert different prosody information such as the accent nucleus, stress levels and four tones to common prosody information. The example of FIG. 22 converts those having the accent nucleus of Japanese, the first stress of English and the second and fourth tones of Chinese to a common prosody label "P (Primary)" and similarly to S and N, that is, three kinds of prosody labels in total thereafter respectively. Such a prosody label conversion rule may be either created manually or created automatically according to a criterion such as a degree of similarity of the prosody information. In this example, the prosody environment before and after the conversion is not considered. It is also possible, however, to perform more detailed prosody label conversion by considering the prosody environment before and after it.

Hereunder, as for the segment data configured by the feature vectors including such prosody information, consideration is given as to application to the first embodiment (the method of generating the centroid segment and rendering it as the representative segment) and to the second embodiment (the method of selecting the representative segment from the segment set included in each cluster).

Figure 23:
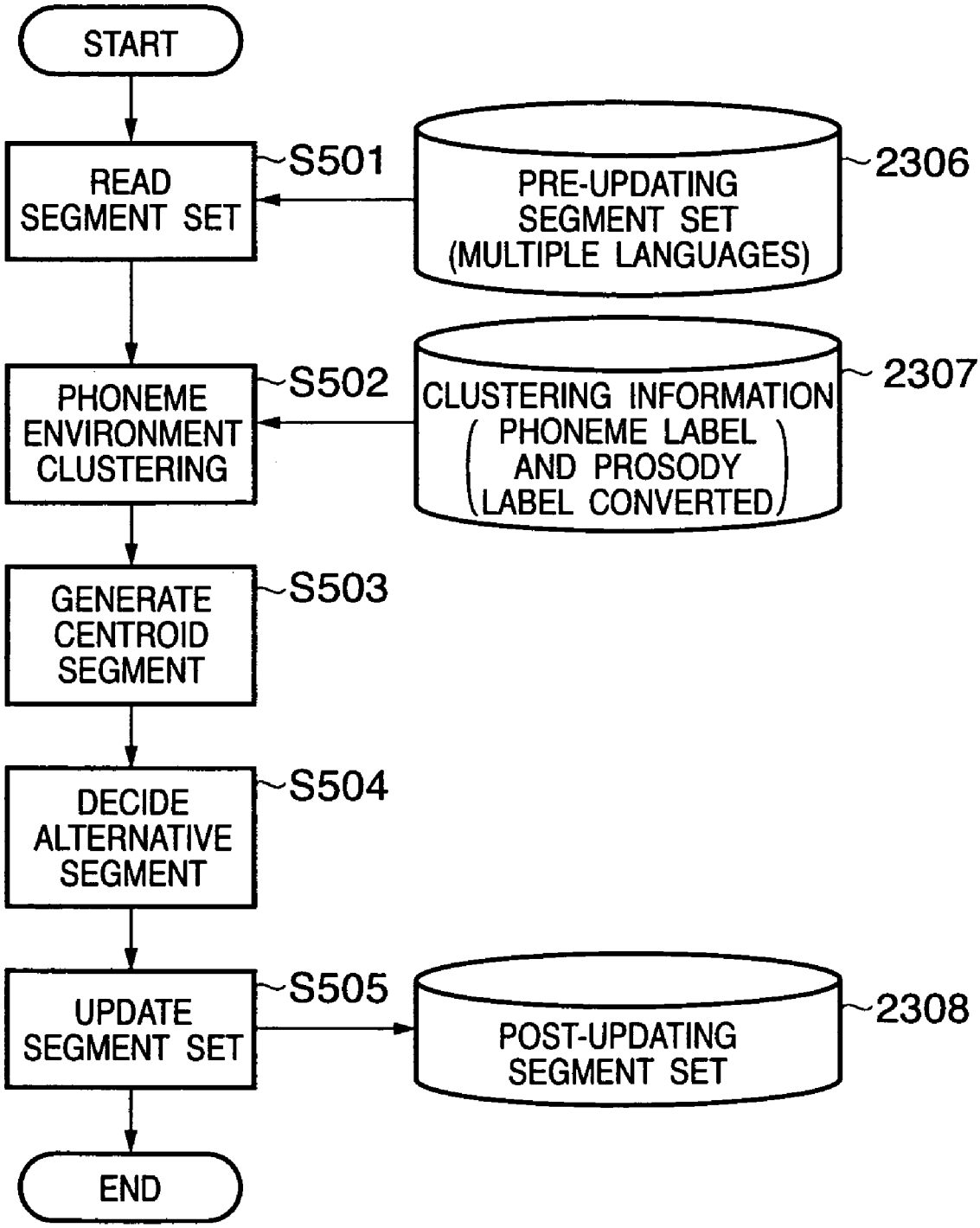
FIG. 23 is a flowchart showing the segment set creating process by the centroid segment generating method according to the sixth embodiment.

First, the application to the first embodiment will be described. FIG. 23 is a flowchart showing the segment set creating process by the centroid segment generating method according to this embodiment. This processing flow is basically the same as the flow shown in FIG. 5. However, it is different in that a segment set of multiple languages 2306 having the phoneme label and prosody label converted is used as the segment set before updating, and clustering information 2307 having the phoneme label and prosody label converted is used as the clustering information used in the step S502.

Figure 24:
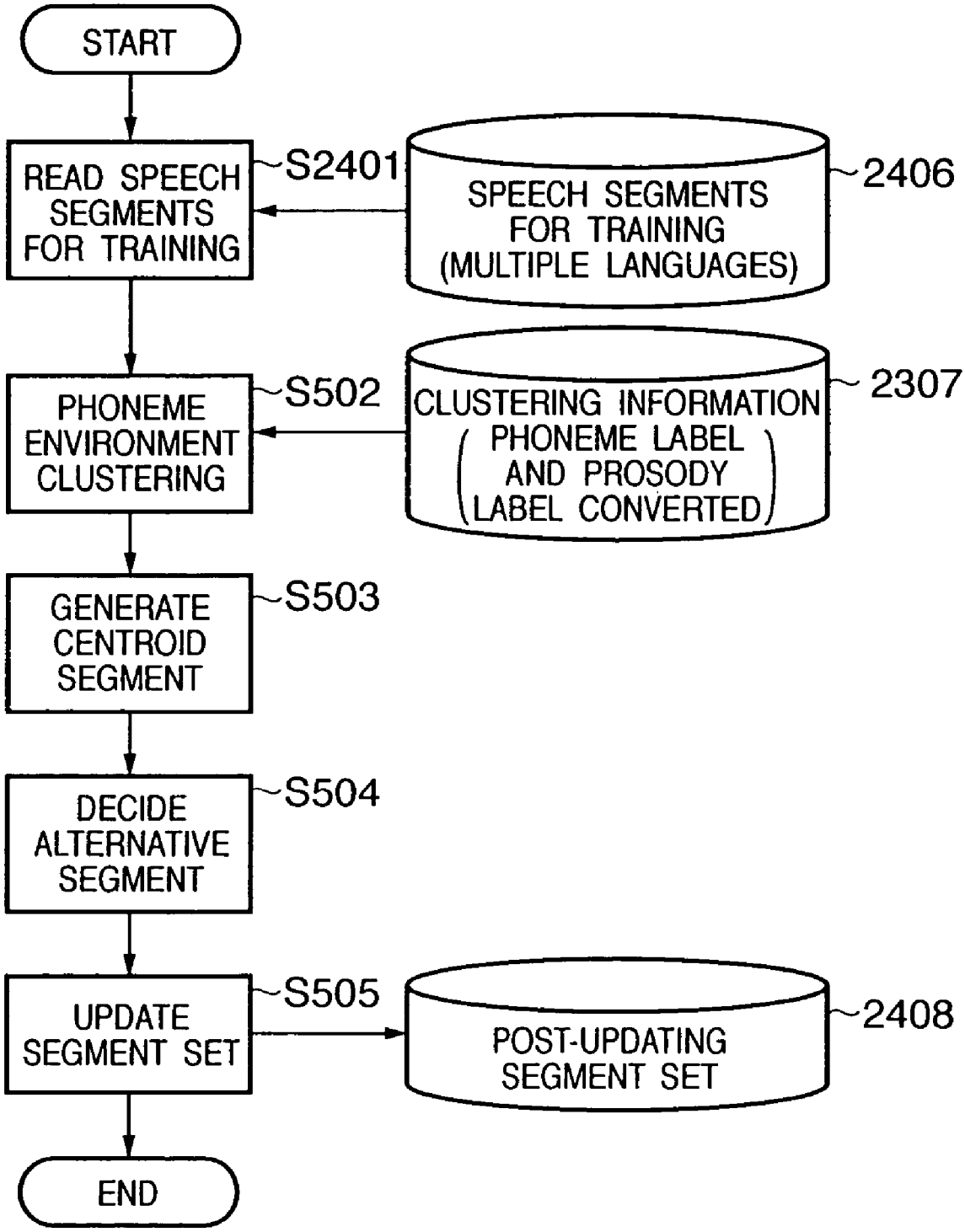
FIG. 24 is a flowchart showing another example of the segment set creating process by the centroid segment generating method according to the sixth embodiment.

FIG. 24 is a flowchart showing another example of the segment set creating process by the centroid segment generating method. Here, speech segments for training of multiple languages 2406 are read (step S2401) instead of the step S501. In the next step S502, the phoneme environment clustering is performed to the speech segments for training 2406. It is different from FIG. 23 in that the step S2401 replacing the step S501 is the process for the entire speech segments for training rather than the process intended for the segment sets.

Figure 25:
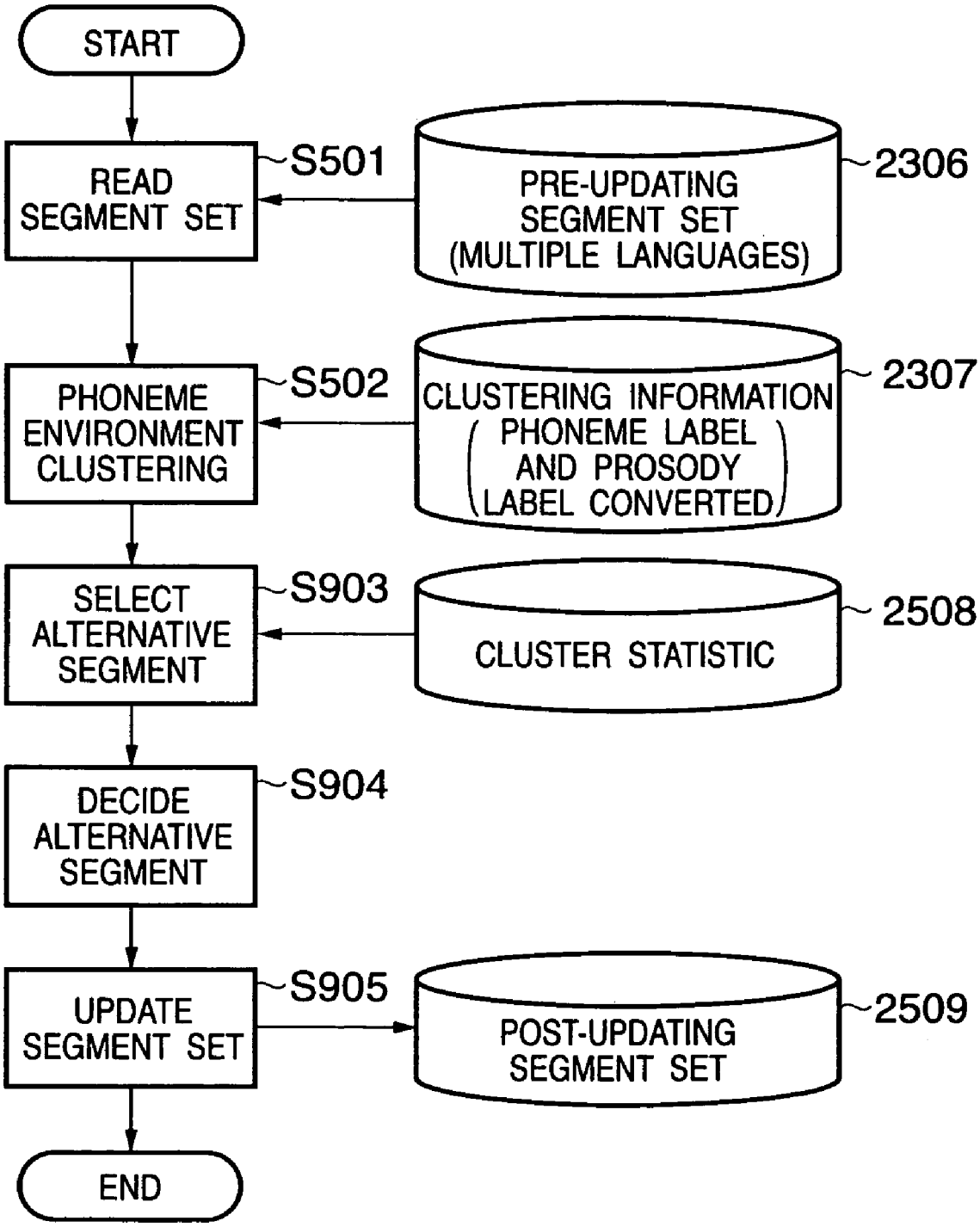
FIG. 25 is a flowchart showing the segment set creating process by the representative segment selecting method according to the sixth embodiment.

Next, the application to the second embodiment will be described. FIG. 25 is a flowchart showing the segment set creating process by the representative segment selecting method according to this embodiment. This processing flow is basically the same as the flow shown in FIG. 9. However, it is different in that the segment set of multiple languages 2306 having the phoneme label and prosody label converted is used as the segment set before updating, and the clustering information 2307 having the phoneme label and prosody label converted is used as the clustering information used in the step S502.

Figure 26:
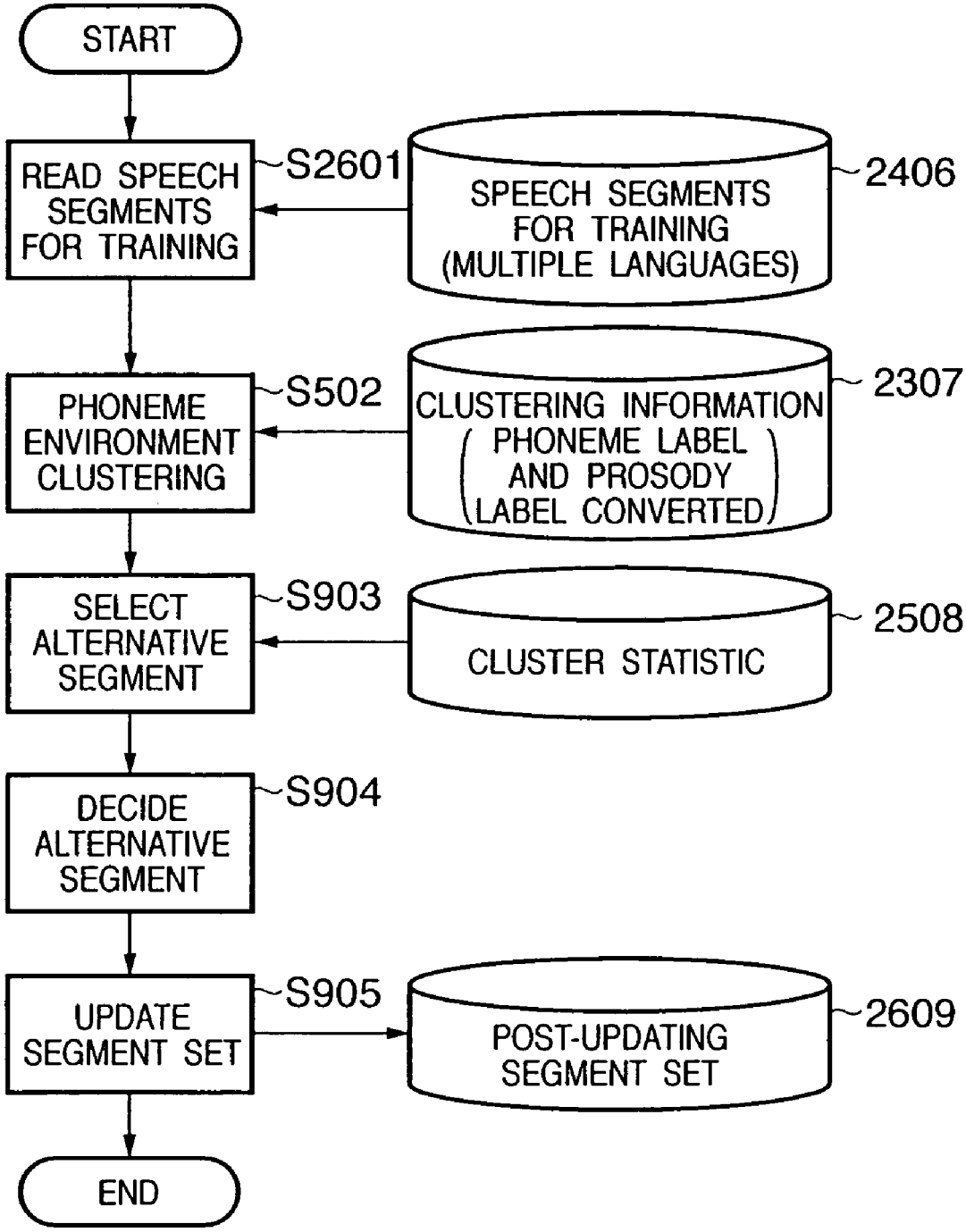
FIG. 26 is a flowchart showing another example of the segment set creating process by the representative segment selecting method according to the sixth embodiment.

FIG. 26 is a flowchart showing another example of the segment set creating process by the representative segment selecting method according to this embodiment. Here, the speech segments for training of multiple languages 2406 are read (step S2601) instead of the step S501. In the next step S502, the phoneme environment clustering is performed to the speech segments for training 2406. It is different from FIG. 25 in that the step S2601 replacing the step S501 is the process for the entire speech segments for training rather than the process intended for the segment sets.

Figure 27:
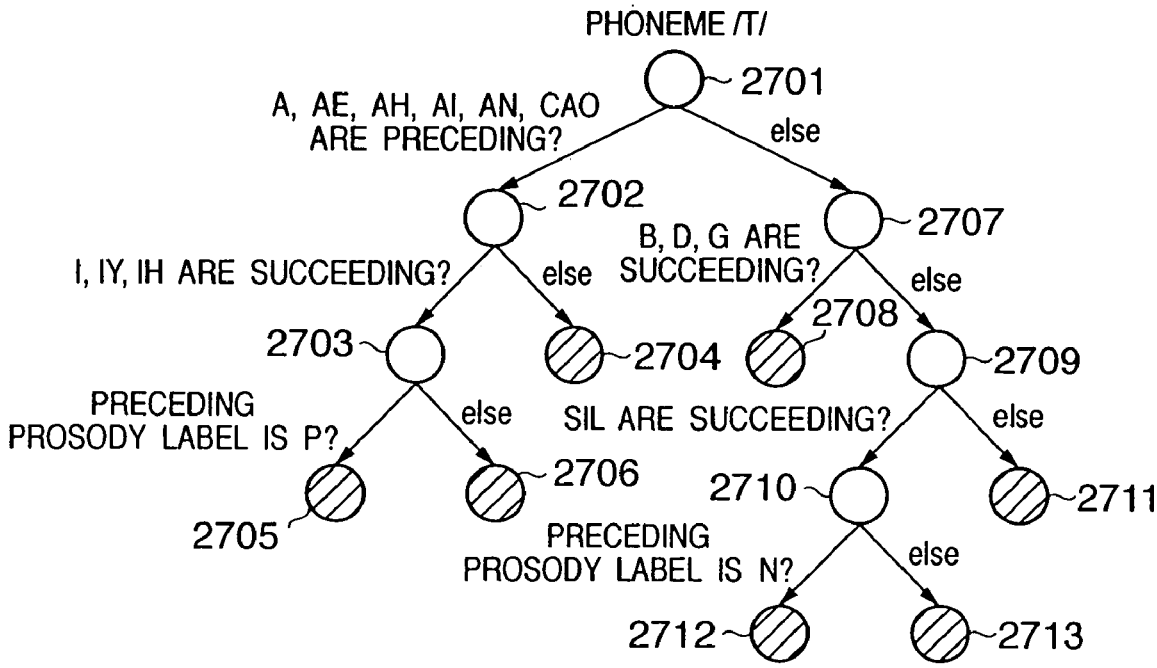
FIG. 27 is a diagram showing an example of the decision tree used on performing the clustering to the segment set of multiple languages considering the phoneme environment and a prosody environment as the phonological environment according to the sixth embodiment.

FIG. 27 shows an example of the decision tree used on performing the clustering to the segment set of multiple languages considering the phoneme environment and a prosody environment as the phonological environment.

The above sixth embodiment shows that the present invention is applicable to the segment set of multiple languages by considering the phoneme environment and a prosody environment as the phonological environment.

Seventh Embodiment

The above-mentioned embodiments generate the centroid segment from the segment set belonging to each cluster or select the representative segment highly relevant to the cluster from the segment set so as to decide the representative segment. To be more specific, the representative segment is decided by using only the segment set in each cluster or the cluster statistic, and no consideration is given to the relevance ratio for a cluster group to which each cluster is connectable or a segment set group belonging to that cluster group. However, it is possible to consider this by the following two methods.

The first method is as follows. The triphones belonging to a certain cluster ("cluster 1") are "i−a+b" and "e−a+b." In this case, the triphone connectable before the cluster 1 is "*−*+i" or "*−*+e" while the triphone connectable after the cluster 1 is "b−*+*." In this case, the relevance ratios are acquired as to the case of connecting "*−*+i" or "*−*+e" before "i−a+b" and connecting "b−*+*" after "i−a+b" and the case of connecting "*−*+i" or "*−*+e" before "e−a+b" and connecting "b−*+*" after "e−a+b" so as to compare the two and render the higher one as the representative segment. Here, a spectral distortion at a connection point may be used as the relevance ratio for instance (the larger the spectral distortion is, the lower the relevance ratio becomes). As for the method of selecting the representative segment considering the spectral distortion at the connection point, it is also possible to acquire it by using the method disclosed in Japanese Patent Laid-Open No. 2001-282273.

As for the second method, it does not seek the relevance ratio of "i−a+b" or "e−a+b" and the segment set group connectable thereto but seeks the relevance ratio for the cluster statistic of the cluster group to which the segment set group connectable thereto belongs. To be more precise, the relevance ratio (S1) of "i−a+b" is acquired as a sum of the relevance ratio (S11) of "i−a+b" to the cluster group to which "*−*+i" and "*−*+e" belong and the relevance ratio (S12) of "i−a+b" to the cluster group to which "b−*+*" belongs.

Similarly, the relevance ratio (S2) of "e−a+b" is acquired as a sum of the relevance ratio (S21) of "e−a+b" to the cluster group to which "*−*+i" and "*−*+e" belong and the relevance ratio (S22) of "e−a+b" to the cluster group to which "b−*+*" belongs. Next, S1 and S2 are compared to render the higher one as the representative segment. Here, the relevance ratio can be acquired, for instance, as the likelihood of the feature parameters of the segment set at the connection point for the statistic of each cluster group (the higher the likelihood is, the higher the relevance ratio becomes).

The aforementioned example simply compared the relevance ratios of "i−a+b" and "e−a+b." To be more precise, however, it is preferable to be normalized (weighted) according to the numbers of connectable segments and clusters.

Eighth Embodiment

According to the embodiments described so far, the phoneme environment was described by using the information on the triphones or speakers. However, the present invention is not limited thereto. The present invention is also applicable to those relating to the phonemes and syllables (diphones and so on), those relating to genders (male and female) of the speakers, those relating to age groups (children, students, adults, the elderly and so on) of the speakers, and those relating to voice quality (cheery, dark and so on) of the speakers. Also, the present invention is applicable to those relating to dialects (Kanto and Kansai dialects and so on) and languages (Japanese, English and so on) of the speakers, those relating to prosodic characteristics (fundamental frequency, duration and power) of the segments, and those relating to quality (SN ratio and so on) of the segments. Further, the present invention is applicable to the environment (recording place, microphone and so on) on recording the segments and to any combination of these.

Other Embodiments

Note that the present invention can be applied to an apparatus comprising a single device or to system constituted by a plurality of devices.

Furthermore, the invention can be implemented by supplying a software program, which implements the functions of the preceding embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any-form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the preceding embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the preceding embodiments can be implemented by this processing.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-268714 filed on Sep. 15, 2004, the entire contents of which are hereby incorporated by reference herein.

What is claimed is:

1. A computer implemented segment set creating method for creating on a computer a speech segment set used for multilingual speech synthesis, the computer implemented method comprising the steps of:

(a) obtaining a first segment set, the set including a phoneme environment, address data of each segment of respective languages, and segment data of each segment, which are corresponding with each other;

(b) converting a plurality of sets of phoneme labels defined in each language into a common set of phoneme labels shared by the multiple languages;

(c) converting a plurality of sets of prosody labels defined in each language into a common set of prosody labels shared by the multiple languages;

(d) creating triphone models from a speech database for training;

(e) creating a decision tree using the triphone models and a set of questions relating to the phonological environment, the phonological environment including a phoneme environment represented by the common set of phoneme labels and prosody environment represented by the common set of prosody labels;

(f) performing clustering of the first segment set using the decision tree;

(g) for each cluster obtained in step (f), selecting a template segment having the maximum time length of the largest number of pitch periods of the segments belonging to a cluster;

(h) deforming the segments belonging to the cluster to have the number of pitch periods and the pitch period length of the template segment;

(i) generating a representative segment of a segment set belonging to the cluster by calculating an average of the deformed segments;

(j) for each cluster, replacing segments belonging to the cluster with the representative segment and deleting segment data of the replaced segments; and (k) creating a second segment set as an updated set of the first segment set by replacing the address data of each replaced segment with address data of a corresponding representative segment.

2. The computer implemented segment set creating method according to claim 1, wherein the first and second segment sets are the segment sets of multiple speakers respectively.

3. The computer implemented segment set creating method according to claim 1, wherein the first and second segment sets are used for the speech synthesis based on waveform processing respectively.

4. The computer implemented segment set creating method according to claim 1, wherein the phoneme environment includes any combination of the information on the phonemes and syllables, information on genders of speakers, information on age groups of the speakers, information on voice quality of the speakers, information on languages or dialects of the speakers, information on prosodic characteristics of the segments, information on quality of the segments and information on the environment on recording the segments.

5. A program for causing a computer to execute the computer implemented segment set creating method according to claim 1.

6. A computer-readable storage medium storing the program according to claim 5.

7. A segment set creating apparatus for creating a speech segment set used for multilingual speech synthesis, the apparatus comprising:

means for obtaining a first segment set, the set including a phoneme environment, address data of each segment of respective languages, and segment data of each segment, which are corresponding with each other;

means for converting a plurality of sets of phoneme labels defined in each language into a common set of phoneme labels shared by the multiple languages;

means for converting a plurality of sets of prosody labels defined in each language into a common set of prosody labels shared by the multiple languages;

means for creating triphone models from a speech database for training;

means for creating a decision tree using the triphone models and a set of questions relating to the phonological environment, the phonological environment including a phoneme environment represented by the common set of phoneme labels and prosody environment represented by the common set of prosody labels;

means for performing clustering of the first segment set using the decision tree;

for each cluster obtained by said means for performing clustering of the first segment set, means for selecting a template segment having the maximum time length of the largest number of pitch periods of the segments belonging to a cluster;

means for deforming the segments belonging to the cluster to have the number of pitch periods and the pitch period length of the template segment;

means for generating a representative segment of a segment set belonging to the cluster by calculating an average of the deformed segments;

means for replacing, for each cluster, segments belonging to the cluster with the generated representative segment;

means for deleting segment data of the replaced segments; and means for creating a second segment set as an updated set of the first segment set by replacing the address data of each replaced segment with address data of a corresponding representative segment.

* * * * *